US006890087B2

(12) United States Patent
Ono

(10) Patent No.: US 6,890,087 B2
(45) Date of Patent: May 10, 2005

(54) APERTURE FLUORESCENT LAMP, SURFACE ILLUMINATOR, MANUFACTURING METHODS THEREOF, LIQUID CRYSTAL DISPLAY DEVICE, AND ELECTRONIC DEVICE

(75) Inventor: Shin-Ichirou Ono, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 0 days.

(21) Appl. No.: 10/247,735

(22) Filed: Sep. 20, 2002

(65) Prior Publication Data

US 2003/0016525 A1 Jan. 23, 2003

Related U.S. Application Data

(62) Division of application No. 09/902,710, filed on Jul. 12, 2001, now Pat. No. 6,533,633.

(30) Foreign Application Priority Data

Jul. 14, 2000 (JP) ..... 2000-215239

(51) Int. Cl.[7] ..... H01J 1/62

(52) U.S. Cl. ..... 362/260; 362/225; 362/31; 362/26; 313/488; 313/607

(58) Field of Search ..... 313/488, 485, 313/493, 573, 607, 234, 635; 362/84, 217, 260, 31, 318, 26, 225

(56) References Cited

U.S. PATENT DOCUMENTS

| | | | | |
|---|---|---|---|---|
| 2,138,882 A | | 12/1938 | Robie | |
| 2,336,946 A | | 12/1943 | Marden et al. | |
| 2,421,975 A | | 6/1947 | Williams | |
| 3,115,309 A | | 12/1963 | Spencer et al. | |
| 3,676,728 A | | 7/1972 | Schreurs | 362/260 |
| 3,839,085 A | | 10/1974 | Hulvey et al. | |
| 4,336,479 A | | 6/1982 | Kodama et al. | 313/487 |
| 4,695,763 A | | 9/1987 | Ogasawara et al. | 355/67 |
| 4,797,594 A | | 1/1989 | Sigai et al. | 313/488 |
| 5,055,978 A | | 10/1991 | Rogoff | 362/31 |
| 5,116,272 A | | 5/1992 | Blaisdell et al. | |
| 5,138,223 A | | 8/1992 | Osada et al. | 313/488 |
| 5,182,660 A | | 1/1993 | Tanaka | |
| 5,202,950 A | | 4/1993 | Arego et al. | |
| 5,210,461 A | | 5/1993 | Pai et al. | |
| 5,296,780 A | | 3/1994 | Haraden et al. | |
| 5,645,337 A | | 7/1997 | Gleckman | 362/29 |
| 5,739,879 A | | 4/1998 | Tsai | 349/62 |
| 5,889,366 A | * | 3/1999 | Yokokawa et al. | 313/607 |
| 5,903,095 A | * | 5/1999 | Yoshida et al. | 313/485 |
| 6,186,649 B1 | | 2/2001 | Zou et al. | 362/347 |
| 6,299,328 B1 | | 10/2001 | Wilson | 362/223 |
| 6,402,343 B1 | | 6/2002 | Vollkommer et al. | 362/256 |
| 2003/0016522 A1 | | 1/2003 | Ono | 362/31 |

FOREIGN PATENT DOCUMENTS

| | | |
|---|---|---|
| JP | 6-260088 | 9/1994 |
| JP | 9-306427 | 11/1997 |
| JP | 10-092303 | 4/1998 |
| JP | 2000-030522 | 1/2000 |
| KR | 1998-15426 | 5/1998 |

* cited by examiner

*Primary Examiner*—Thomas M. Sember
(74) *Attorney, Agent, or Firm*—McGinn & Gibb, PLLC

(57) ABSTRACT

A relatively small-diameter aperture fluorescent lamp is manufactured easily with high yield and at low cost. An aperture portion is formed in a manner that a thread-like member is inserted into a glass tube having an ultraviolet ray reflection layer and a phosphor layer formed on its inner surface, the glass tube is bent in a predetermined shape by using a bending jig, the thread-like member is pressed to the phosphor layer formed in a predetermined region in the bending member side of the glass tube while both ends thereof are pulled tight, the thread-like member is reciprocated, and phosphor of the phosphor layer in this region is exfoliated.

21 Claims, 23 Drawing Sheets

APERTURE FLUORESCENT LAMP, SURFACE ILLUMINATOR, MANUFACTURING METHODS THEREOF, LIQUID CRYSTAL DISPLAY DEVICE, AND ELECTRONIC DEVICE

The present Application is a Divisional Application of U.S. patent application Ser. No. 09/902,710, filed on Jul. 12, 2001 now U.S. Pat No. 6,533,633.

BACKGROUND OF THE INVENTION

1. Field of the Invention

The present invention relates to an aperture fluorescent lamp manufacturing method, which is suitably used for manufacturing a relatively small-diameter aperture fluorescent lamp having an aperture portion opened for light projection in a part of a straight glass tube in the axial direction, a manufacturing method of a surface illuminator provided with an aperture fluorescent lamp, a relatively small-diameter aperture fluorescent lamp, a surface illuminator provided with an aperture fluorescent lamp, a liquid crystal display device provided with the surface illuminator, and an electronic device provided with the liquid crystal display device.

The present application claims priority of Japanese Patent Application No.2000-215239 filed on Jul. 14, 2000, which is hereby incorporated by reference.

2. Description of the Related Art

Conventionally, an aperture fluorescent lamp has been available, which emits light in a concentrated manner from an opening potion (referred to as an aperture portion, hereinafter) for light projection provided in a part of a straight glass tube in the axial direction. This aperture fluorescent lamp has widely been used as a backlight source, for example, in a liquid crystal display device for OA (Office Automation) equipment. The aperture fluorescent lamp has also been used as a document illumination light source in a facsimile, a copying machine, or the like.

With regard to a method for manufacturing such an aperture fluorescent lamp, technologies that have been available include, for example, one disclosed in Japanese Patent Laid-open No. Hei 6-260088 for forming an aperture portion by using a method of scraping off a phosphor with a rod (referred to as a first conventional technology), and one disclosed in Japanese Patent Laid-open No. Hei 9-306427 for forming an aperture portion with a photo mask (referred to as a second conventional technology).

In the case of the first conventional technology, as shown in FIG. 30, first, a phosphor is coated on the inner surface of a cylindrical glass tube 101 having both ends opened to form a phosphor layer 102. Then, a metal rod 104 having a brush 103 on a tip portion containing a magnetic substance like that shown in FIG. 31 is inserted from one opening of the glass tube 101 as shown in FIG. 32, and guided by a magnet 105 from the outside of the glass tube 101. The brush 103 is moved in pressed state to the phosphor layer 102 to scrape off the phosphor in a predetermined region, thus forming an aperture portion 106 as shown in FIG. 33.

In the case of the second conventional technology, first, a mixture of a photo-curing resin and a phosphor is coated inside a glass tube. Then, a photo mask (not shown) is attached to a predetermined region, in which an aperture portion 106 is formed, and irradiated with ultraviolet rays. Then, the photo mask is removed, an insensitive portion is washed off with hot pure water, and then dried and subjected to heating and burning. Then, a phosphor layer 102 is formed on other than the aperture portion 106 as shown in FIG. 33.

In addition, in both ends of an aperture fluorescent lamp 107 manufactured in the foregoing manner, as shown in FIG. 34, positioning pieces 108 for aligning an orientation of the aperture portion 106 at backlight assembly are attached.

To manufacture, for example, a backlight 115 of a side-light type, by using the aperture fluorescent lamp 107 having such positioning pieces, as shown in FIGS. 35 and 36, by fitting each of the positioning pieces 108 in a groove of a reflector 109 groove-shaped in section for reflecting and guiding light emitted from the aperture fluorescent lamp 107 to a light guide plate 112, the aperture fluorescent lamp 107 is attached to the reflector 109. Then, the reflector 109 having the aperture fluorescent lamp 107 attached thereto is fixed onto a rear case 110. At this time, the aperture portion 106 is positioned to face a direction (horizontal direction in FIGS. 35 and 36) roughly parallel to the top surface of the rear case 110 as a casing.

On the rear case 110, a reflection sheet 111, the light guide plate 112, and an optical correction sheet 113 are sequentially laminated, and then covered with a center case 114, thus completing the backlight 115.

To manufacture a directly-below backlight 116 of a directly-below type by using aperture fluorescent lamps 107, as shown in FIG. 37B, a plurality of aperture fluorescent lamps 107, 107 . . . , are positioned and disposed on the bottom part of a reflection plate 117 such that the aperture portions 106 can face a direction (directly above in the drawing) vertical to a light emission surface. Above the aperture fluorescent lamps 107, 107 . . . , a diffusion plate 118 is attached for obtaining a surface light source by diffusing emitted or reflected light.

With regard to the method for manufacturing the aperture fluorescent lamp, in the case of the first conventional technology, to manufacture a relatively small-diameter aperture fluorescent lamp, the brush 103 and the metal rod 104 must be formed thin. However, if the metal rod 104 is formed thin, the metal rod 104 is fluttered or bent, damaging the phosphor layer 102 other than the aperture portion 106. Consequently, it is practically difficult to manufacture a small-diameter aperture fluorescent lamp having an inner diameter of 3 mm or less.

In addition, to manufacture an aperture fluorescent lamp having a long glass tube length, length of the metal rod 104 must be made long. Thus, the metal rod 104 is fluttered or bent, damaging the phosphor layer 102 other than the aperture portion 106. Consequently, it is also difficult to manufacture an aperture fluorescent lamp having the long glass tube length.

Therefore, in the backlight as a surface illuminator using the aperture fluorescent lamp manufactured by the foregoing method, for example, as shown in FIG. 36, the size of a housing part 109*h* (FIG. 36) of the aperture fluorescent lamp 107, which is formed by being surrounded with the rear case 110, cannot be reduced. In other words, a longitudinal width $a_0$ including clearances $b_0$ and $c_0$ in upper and lower sides of the aperture fluorescent lamp 107 and a transverse width $d_0$ cannot be reduced. In addition, a width $e_0$, which is regulated by the transverse width $d_0$, of a frame part of the center case 114 above the aperture fluorescent lamp 107 cannot be reduced. Consequently, it is impossible to reduce not only weight of the aperture fluorescent lamp 107 but also those of other members.

It can therefore be understood that there are difficulties of thinning, narrow frame formation, and weight reduction for the backlight using the aperture fluorescent lamp manufactured by the described manufacturing method.

Thus, there are also difficulties of thinning, narrow frame formation, and weight reduction for both of a liquid crystal display device using the backlight and an electronic device using such the liquid crystal display device.

In the case of the second conventional technology, in addition to mixture coating step, exposure, developing, and many other steps are necessary. Thus, much time, and labor must be expended, thereby causing an increase in cost.

Therefore, there are problems of high costs for the backlight 115 as a surface illuminator using the aperture fluorescent lamp 107 manufactured by the described manufacturing method, a liquid crystal display device using the backlight 115, and a device using such the liquid crystal display device.

In the foregoing positioning method of the aperture portion 106, the positioning pieces 108 as members dedicated for positioning are necessary in the manufacturing process of the aperture fluorescent lamp 107.

Thus, material and process costs are increased by attaching (adhering) of the positioning pieces 108, and there are difficulties of thinning, narrow frame formation, and weight reduction when the aperture fluorescent lamp 107 is incorporated in the backlight 115.

If the positioning pieces 108 are omitted, when the aperture fluorescent lamp 107 is attached to the reflector 109 or the center case 114, an assembling operator must check position of the aperture portion 106, and align its orientation, thus making positioning difficult. Since a member around the aperture fluorescent lamp 107 becomes to be a visual obstacle during orientation alignment, the aperture portion 106 cannot be correctly positioned, thus deteriorating yield.

In the case of the directly-below backlight 116 using the aperture fluorescent lamp 107, for example, in a direction (y axis direction in FIG. 37A) orthogonal to the axis of the aperture fluorescent lamp 107 in the upper surface (light emission surface) of the diffusion plate 118, luminance is highest in a position ($Y=Y_0$ in FIG. 38) directly above the aperture fluorescent lamp 107, and the luminance is lowest near a position ($Y=Y_m$) equidistant from the axes of the adjacent aperture fluorescent lamps 107 and 107, thus generating luminance uneveness.

Specifically, as shown in FIG. 38, compared with a distance $L_0$ between the axis of the aperture fluorescent lamp 107 and a position $Q_0$ ($Y=Y_0$, and $Z=Z_0$) directly above the aperture fluorescent lamp 107 in the backside of the diffusion plate 118, a distance $L_m$ between the axis of the aperture fluorescent lamp 107 and a position $Q_m$ ($Y=Y_m$, and $Z=Z_0$) equidistant from the adjacent aperture fluorescent lamps 107 and 107 in the backside of the diffusion plate 118 is longer. Light is diffused and attenuated by an amount equal to such a difference in optical path lengths, making dark a part near the position $Q_m$. Further, near the position $Q_m$, light is obliquely directed from the aperture fluorescent lamp 107. Thus, the component of a light intensity in a direction (Z axis direction) vertical to the light emission surface of the light diffusion plate 118 becomes smaller than that of a light intensity in the position $Q_0$ directly above the aperture fluorescent lamp 107.

Therefore, because of the directional characteristic (relation between the direction of radiation and luminance) of the aperture fluorescent lamp 107, a part directly above the aperture fluorescent lamp becomes bright, and the middle part equidistant from the adjacent aperture fluorescent lamps 107 and 107 becomes dark. As shown in FIG. 37A, the luminance F of light emitted from the diffusion plate 118 is changed in a wave shape in the Y-axis direction of the light emission surface. Consequently, luminance uniformity is deteriorated.

The above problem occurs even when a general lamp other than the aperture fluorescent lamp is used.

Thus, in the conventional art, as shown in FIG. 37B, by setting the distance $L_0$ between the aperture fluorescent lamp 107 and the diffusion plate 118 to be sufficiently long (for example, $L_0$=13 mm to 15 mm), and diffusing light at the diffusion plate 118, luminance uniformity must be adjusted to a level at which the backlight 116 can be used as a product. Consequently, the distance $L_0$ cannot be set equal to a predetermined value or lower.

It can therefore be understood that there are difficulties of thinning and weight reduction in the case of the directly-below backlight 116.

SUMMARY OF THE INVENTION

In view of the above, it is an object of the present invention to provide an aperture fluorescent lamp manufacturing method capable of easily manufacturing even a relatively small-diameter aperture fluorescent lamp with high yield and at low cost.

It is another object of the present invention to provide a small-diameter aperture fluorescent lamp, a thin, narrow-frame, and lightweight surface illuminator, a liquid crystal display device having the surface illuminator, and an electronic device having the liquid crystal display device at low costs.

It is still another object of the present invention to provide a surface illuminator manufacturing method capable of accurately and easily positioning an aperture portion, improving yield, and contributing to thinning, narrow frame formation, weight reduction, and achievement of low cost.

It is still another object of the present invention to provide a surface illuminator capable of obtaining good luminance uniformity, a liquid crystal display device having the surface illuminator, and an electronic device having the liquid crystal display device.

According to a first aspect of the present invention, there is provided an aperture fluorescent lamp manufacturing method for forming an aperture portion opened for light projection by forming a phosphor layer on an inner surface of a glass tube, and then eliminating the phosphor layer in a predetermined region in an axial direction of the glass tube, including:

a member inserting step of inserting one selected from a thread-like member and a belt-like member having a predetermined surface roughness and a predetermined tensile strength into the glass tube having the phosphor layer formed therein; and a phosphor exfoliating step of exfoliating a phosphor by sliding the one selected from the thread-like member and the belt-like member in relative displacement to the phosphor layer while the one selected from the thread-like member and the belt-like member is in contact by pressure with the phosphor layer formed in the predetermined region.

In the foregoing first aspect, a preferable mode is one wherein, in the member inserting step, an end of the one selected from the thread-like member and the belt-like member is inserted from one opening of the glass tube, and the one selected from the thread-like member and the belt-like member is sucked from an opposite opening.

Also, a preferable mode is one wherein, in the phosphor exfoliating step, the one selected from the thread-like member and the belt-like member is slid while the glass tube is bent to a side of forming the aperture portion.

Also, a preferable mode is one that further includes a glass tube rotating step of rotating the glass tube having the phosphor layer formed therein around an axis of the glass tube in a range of a predetermined angle, wherein the glass tube rotating step and the phosphor exfoliating step are executed alternately or simultaneously.

Also, a preferable mode is one that further includes a member rotating step of rotating the one selected from the thread-like member and the belt-like member around an axis of the glass tube in a range of a predetermined angle, wherein the member rotating step and the phosphor exfoliating step are executed alternately or simultaneously.

Also, a preferable mode is one that further includes a phosphor eliminating step of eliminating the phosphor exfoliated in the phosphor exfoliating step.

Also, a preferable mode is one wherein, in the phosphor eliminating step, the exfoliated phosphor is sucked from any one of the openings of the glass tube.

Also, a preferable mode is one wherein the one selected from the thread-like member and the belt-like member has flexibility, and predetermined concave and convex machining is executed at least in a portion brought into contact with the phosphor layer.

Also, a preferable mode is one wherein the one selected from the thread-like member and the belt-like member is made of an adsorbent material or an adhesive material for sticking the phosphor.

Also, a preferable mode is one wherein the thread-like member is made of fiber or metal.

Also, a preferable mode is one wherein a plurality of the belt-like aperture portions are formed in the axial direction of the glass tube.

According to a second aspect of the present invention, there is provided a method of manufacturing a surface illuminator including: an aperture fluorescent lamp having a glass tube, a pair of electrodes sealed to both ends of the glass tube, a phosphor layer formed on an inner surface of the glass tube, and an aperture portion formed by eliminating the phosphor layer in a predetermined region in an axial direction of the glass tube and opened for light projection; and a holding frame member for holding the aperture fluorescent lamp by a supporting member, including the steps of:

preparing the aperture fluorescent lamp having a tip part of a lead conductor, which is connected to the electrode, formed in a predetermined convex shape, and the supporting member having a concave or a hole part for fixing the aperture fluorescent lamp while the concave or the hole part is fitted to the tip part of the lead conductor to face a predetermined direction; and fitting the tip part of the lead conductor in the concave or the hole part of the supporting member attached to the holding frame member, thus positioning the aperture fluorescent lamp in a predetermined posture.

According to a third aspect of the present invention, there is provided an aperture fluorescent lamp including: a phosphor layer formed on an inner surface of a glass tube; and an aperture portion formed by eliminating the phosphor layer in a predetermined region in an axial direction of the glass tube and opened for light projection, wherein a plurality of the aperture portions, each having a belt-like shape, are formed.

In the foregoing third aspect, a preferable mode is one wherein number of the aperture portions is two, the aperture portions being disposed to be separated from each other by a predetermined angle gap around an axis of the glass tube.

According to a fourth aspect of the present invention, there is provided a surface illuminator including:

an aperture fluorescent lamp having a phosphor layer formed on an inner surface of a glass tube, and an aperture portion formed by eliminating the phosphor layer in a predetermined region in an axial direction of the glass tube and opened for light projection; and a light guide unit formed by sequentially laminating at least a reflection sheet and a light guide plate, and adapted to take in light emitted from the aperture fluorescent lamp from a surface facing the aperture fluorescent lamp and guide the light in a direction roughly perpendicular to a light emission surface of the surface illuminator, wherein the reflection sheet is extended to at least a bottom part side of the aperture fluorescent lamp.

In the foregoing fourth aspect, a preferable mode is one wherein the reflection sheet is wound around the aperture fluorescent lamp and extended to a light emission surface side of the aperture fluorescent lamp.

According to a fifth aspect of the present invention, there is provided a surface illuminator including:

an aperture fluorescent lamp having a phosphor layer formed on an inner surface of a glass tube, and an aperture portion formed by eliminating the phosphor layer in a predetermined region in an axial direction of the glass tube and opened for light projection;

a light guide unit formed by sequentially laminating at least a reflection sheet and a light guide plate, and adapted to take in light emitted from the aperture fluorescent lamp from a surface facing the aperture fluorescent lamp and guide the light in a direction roughly perpendicular to a light emission surface of the surface illuminator; and a reflection member disposed in at least a light emission surface side of the aperture fluorescent lamp.

In the foregoing fourth and fifth aspects, a preferable mode is one that further includes a holding frame member for holding at least one of the aperture fluorescent lamp and the light guide unit, wherein the holding frame member and the aperture fluorescent lamp are disposed to be brought into contact with each other directly or through the reflection sheet.

According to a sixth aspect of the present invention, there is provided a surface illuminator including:

a single or a plurality of aperture fluorescent lamps having a phosphor layer formed on an inner surface of a glass tube, and an aperture portion formed by eliminating the phosphor layer in a predetermined region in an axial direction of the glass tube and opened for light projection, the single or the plurality of aperture fluorescent lamps being disposed on a surface roughly parallel to a light emission surface of the surface illuminator, wherein:

each of the aperture fluorescent lamps has two aperture portions, each having a belt-like shape, disposed around an axis of the aperture fluorescent lamp to be separated from each other by a predetermined angle gap; and each of the aperture fluorescent lamps is disposed while a symmetry axis of a cross section of the aperture fluorescent lamp passing through a middle part of the two aperture portions is directed in a direction roughly vertical to the light emission surface.

According to a seventh aspect of the present invention, there is provided a surface illuminator including:

a single or a plurality of aperture fluorescent lamps having an aperture portion disposed on a surface roughly parallel to a light emission surface to be directed in a direction roughly perpendicular to the light emission surface, wherein;

the aperture fluorescent lamp includes a glass tube having an inner diameter set equal to about 3 mm or less.

According to a eighth aspect of the present invention, there is provided a surface illuminator including:

an aperture fluorescent lamp having a glass tube, a pair of electrodes sealed to both ends of the glass tube, a phosphor layer formed on an inner surface of the glass tube, and an aperture portion formed by eliminating the phosphor layer in a predetermined region in an axial direction of the glass tube and opened for light projection; and a holding frame member for holding the aperture fluorescent lamp through a supporting member, wherein a lead conductor connected to the electrode has a tip part machined in a predetermined convex shape, the supporting member has a pair of concaves or a pair of hole parts to be fitted to the tip part of the lead conductor, and the tip part and the concaves or the hole parts are machined to fix the aperture fluorescent lamp in a fitted state while the aperture portion is directed in a predetermined direction.

According to a ninth aspect of the present invention, there is provided a liquid crystal display device, including:

a surface illuminator specified above; and a liquid crystal panel.

According to a tenth aspect of the present invention, there is provided an electronic device, including a liquid crystal display device specified above.

With the above configurations, since the phosphor is exfoliated by using the thread-like member or the belt-like member, even in the case of the small-diameter glass tube having the inner diameter set equal to, for example, 3 mm or less, the aperture portion can be easily and accurately formed at low cost and with high reliability.

Even in the case of the glass tube having a long tube length, the aperture portion can be easily and accurately formed at low cost and with high reliability.

By using the small-diameter aperture fluorescent lamp, luminance efficiency can be increased.

By using the small-diameter aperture fluorescent lamp, a thin, narrow-frame and lightweight surface illuminator can be provided. By using the surface illuminator, a thin, narrow-frame and lightweight liquid crystal display device can be provided. By using this liquid crystal display device, a thin, narrow-frame and lightweight electronic device can be provided.

In addition, the aperture portion can be easily and surely positioned only by fitting the tip part of the lead conductor machined in a predetermined convex shape in the concave or hole part of the supporting member. Thus, work efficiency can be increased, yield can be improved, and work automation can be dealt with.

By using the small-diameter aperture fluorescent lamp, even in the case of a surface illuminator of the directly-below type, a thin and lightweight surface illuminator can be provided.

Furthermore, in the surface illuminator of the directly-below type, a plurality of the aperture fluorescent lamps having two aperture portions separated from each other by a predetermined angle gap around the axis are arrayed. Thus, the surface illuminator can be improved in luminance uniformity, and can be made thin and lightweight.

BRIEF DESCRIPTION OF THE DRAWINGS

Other objects, features, and advantages of the present invention will become more apparent from the following detailed description when read in conjunction with the accompanying drawings, in which.

DESCRIPTION OF THE PREFERRED EMBODIMENTS

Best modes for carrying out the present invention will be described in further detail using various embodiments with reference to the accompanying drawings.

First Embodiment

Figure 1A:
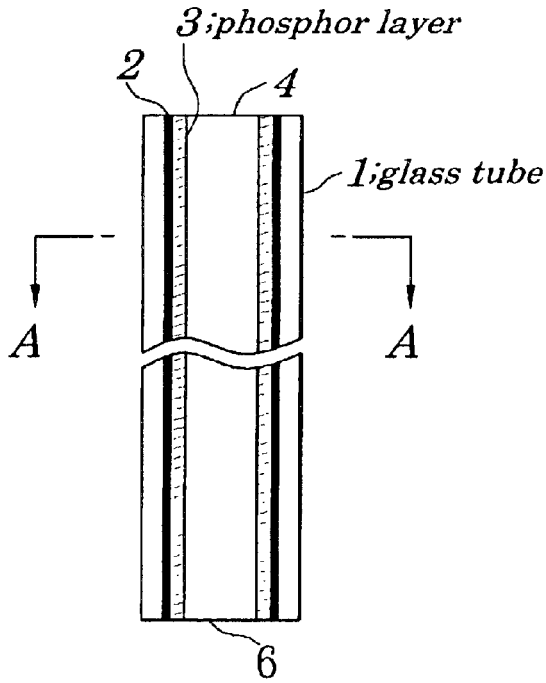
FIGS. 1A and 1B are process views illustrating an aperture fluorescent lamp manufacturing method according to a first embodiment of the present invention.
Figure 3A:
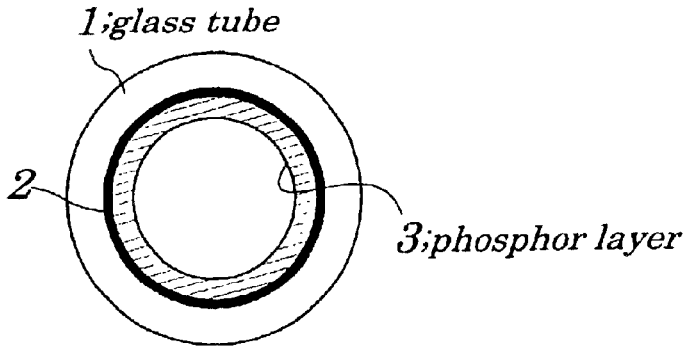
FIGS. 3A and 3B are views illustrating the aperture fluorescent lamp manufacturing method of the first embodiment, specifically, FIG. 3A being a sectional view taken along line A—A of FIG. 1A, and FIG. 3B being a sectional view taken along line B—B of FIG. 2B.
Figure 3B:
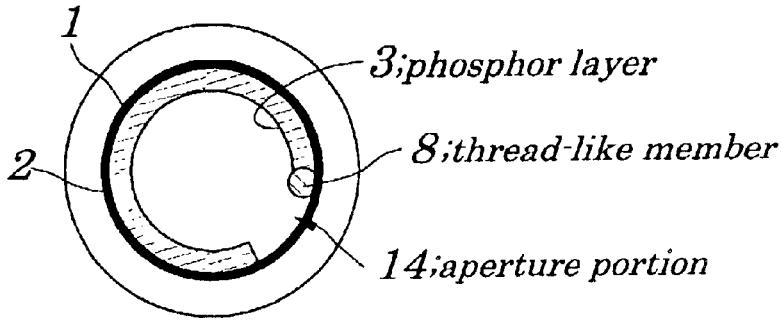
Figure 4:
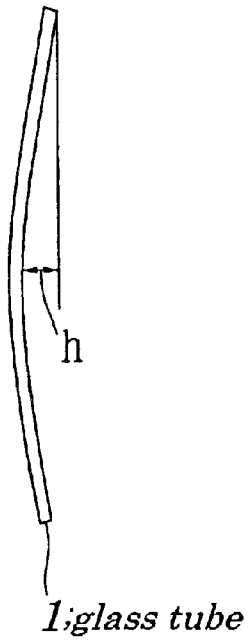
FIG. 4 is a view illustrating the aperture fluorescent lamp manufacturing method of the first embodiment of the present invention.
Figure 5:
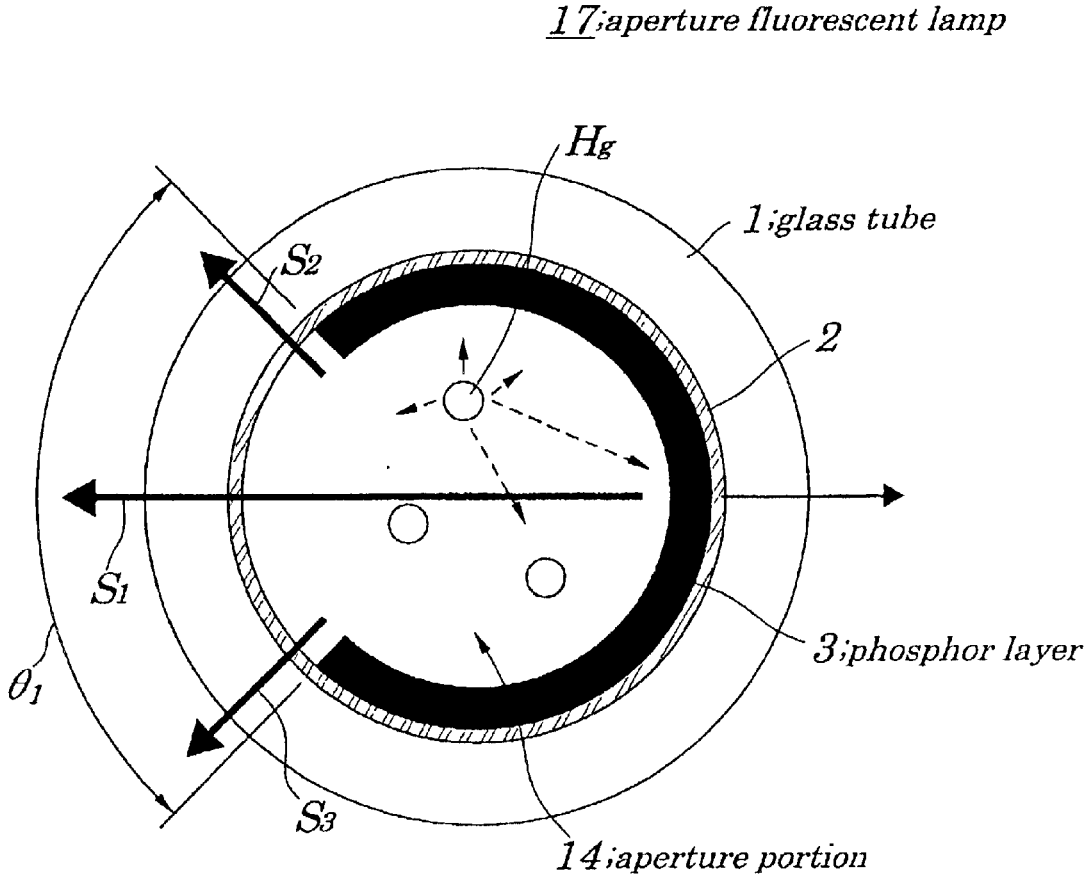
FIG. 5 is a sectional view showing a constitution of the aperture fluorescent lamp of the first embodiment.
Figure 6:
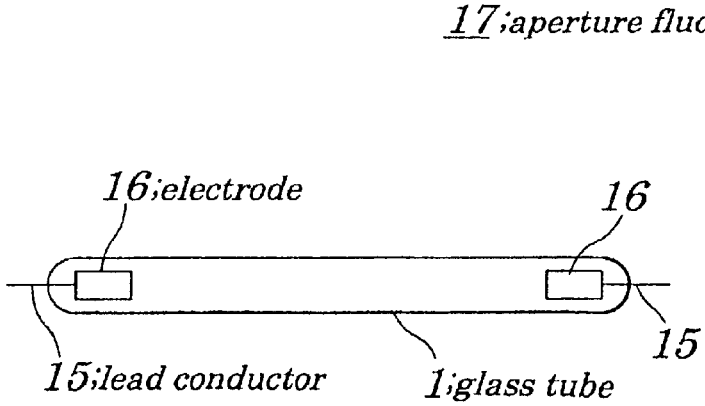
FIG. 6 is another sectional view showing the constitution of the aperture fluorescent lamp of the first embodiment.
Figure 7:
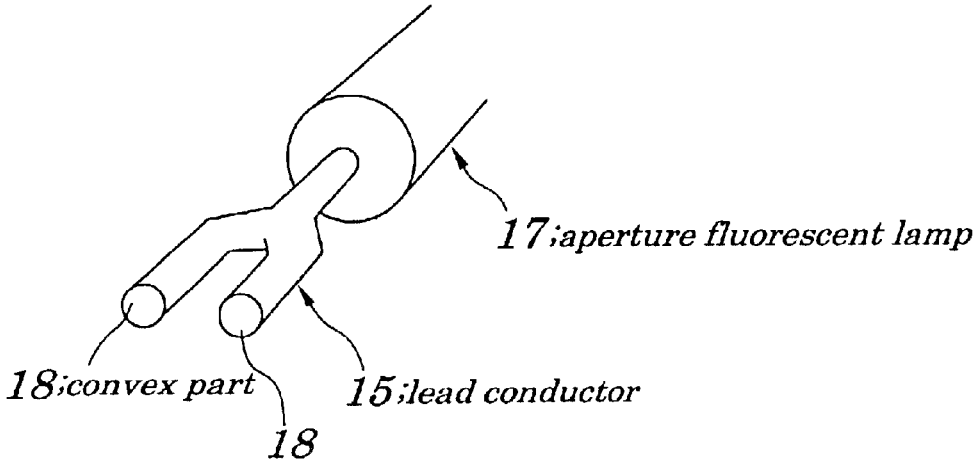
FIG. 7 is a partially-expanded perspective view showing a constitution of a lead conductor of the aperture fluorescent lamp of the first embodiment.
Figure 8:
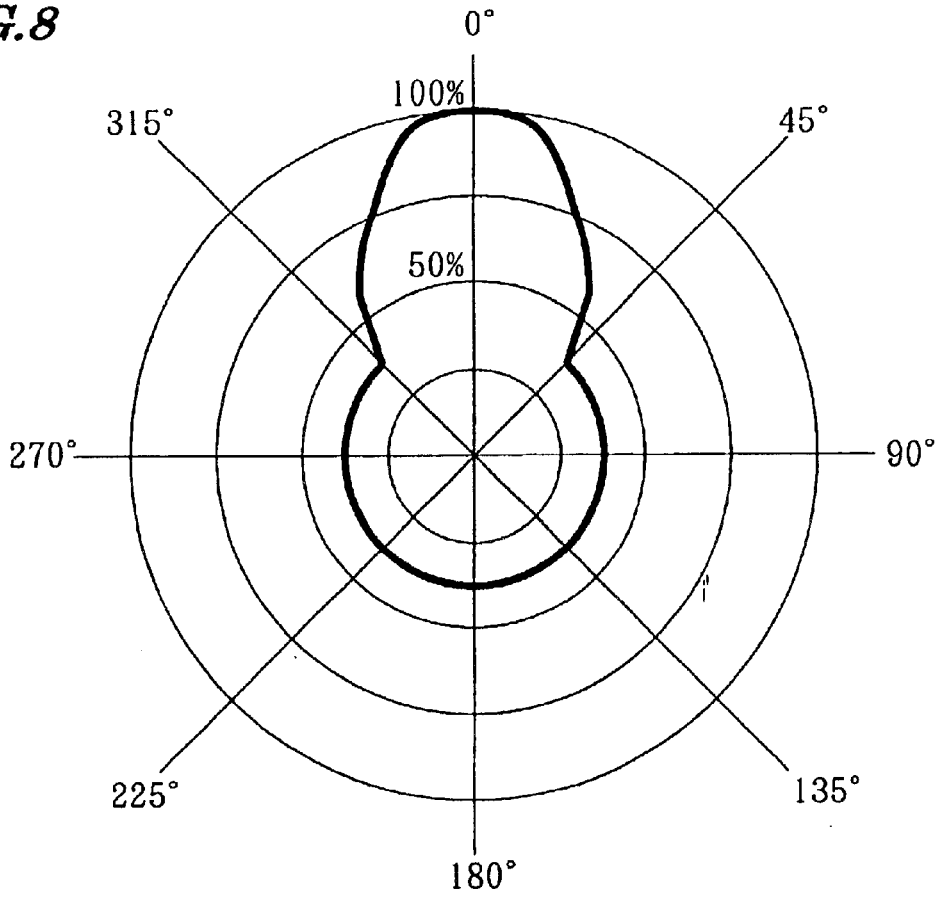
FIG. 8 is a characteristic view showing a relation (directional characteristic) between a radiation direction and luminance of the aperture fluorescent lamp.
Figure 9:
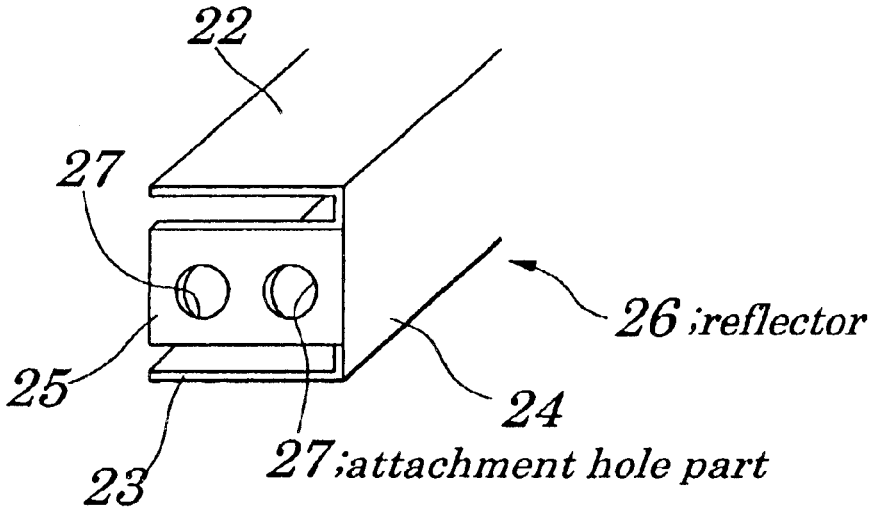
FIG. 9 is a partially expanded perspective view showing a constitution of an end portion of a reflector of the first embodiment.
Figure 10:
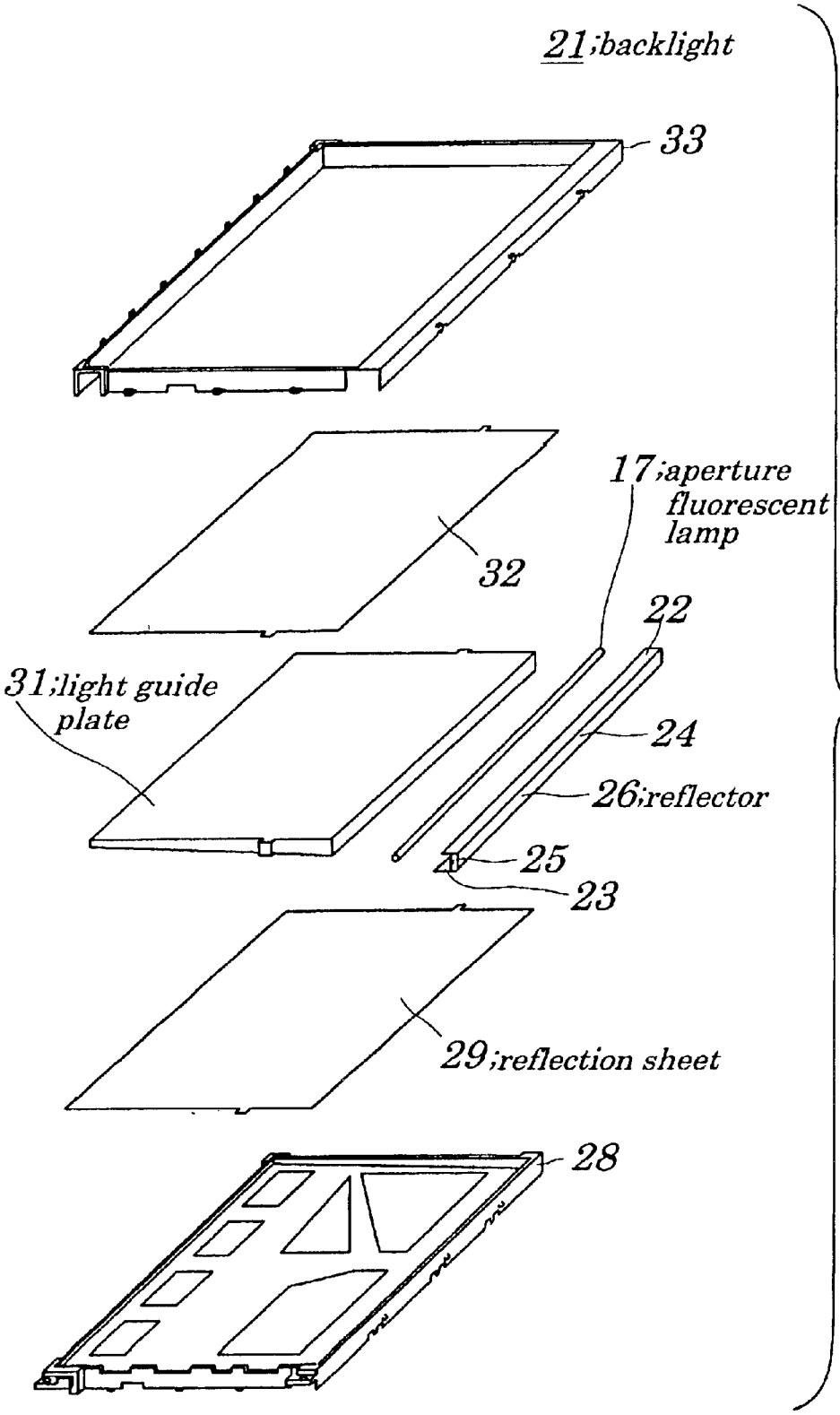
FIG. 10 is an exploded perspective view showing a constitution of a backlight of the first embodiment.
Figure 11:
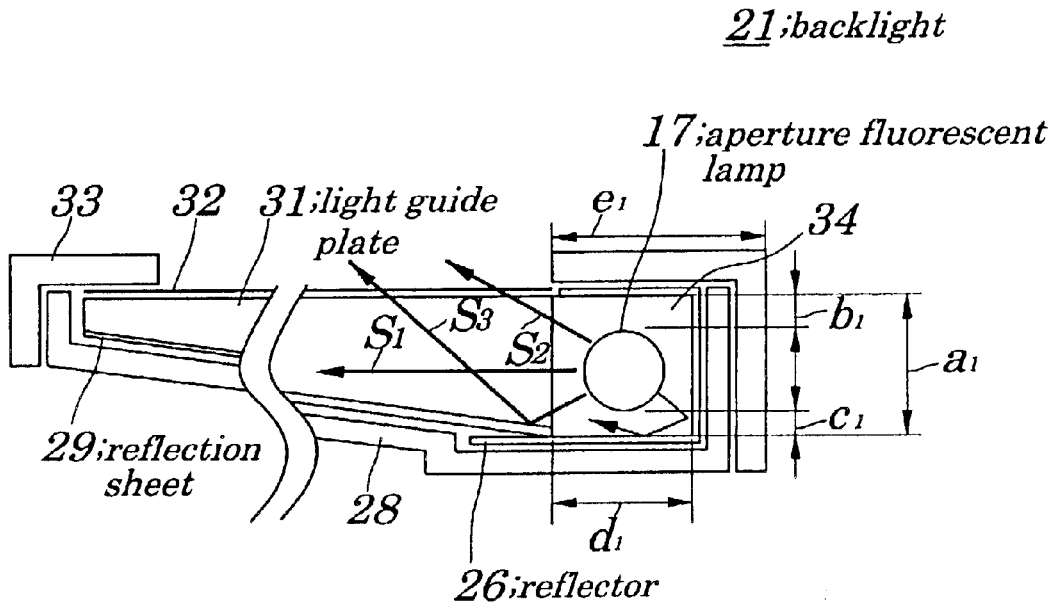
FIG. 11 is a sectional view showing the constitution of the backlight of the first embodiment.
Figure 12:
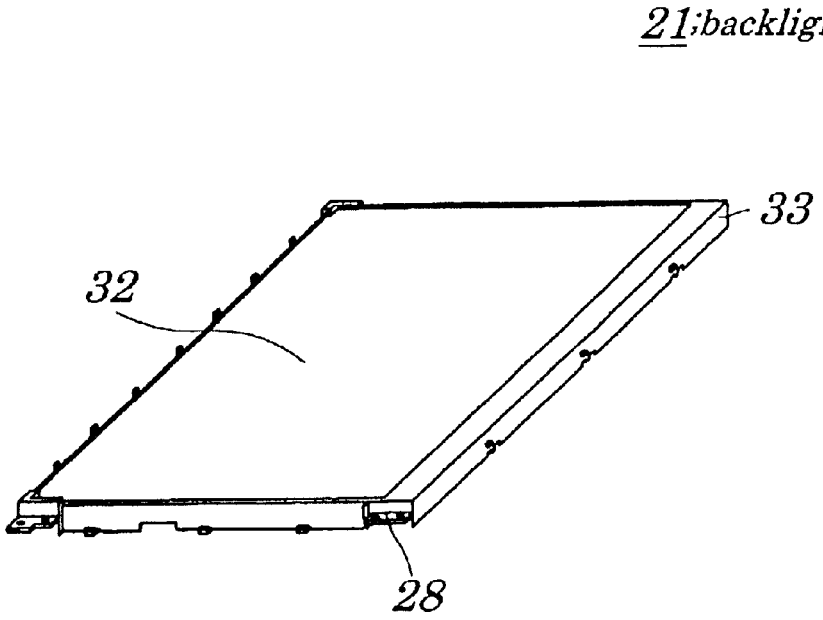
FIG. 12 is a perspective view showing the constitution of the backlight of the first embodiment.
Figure 13:
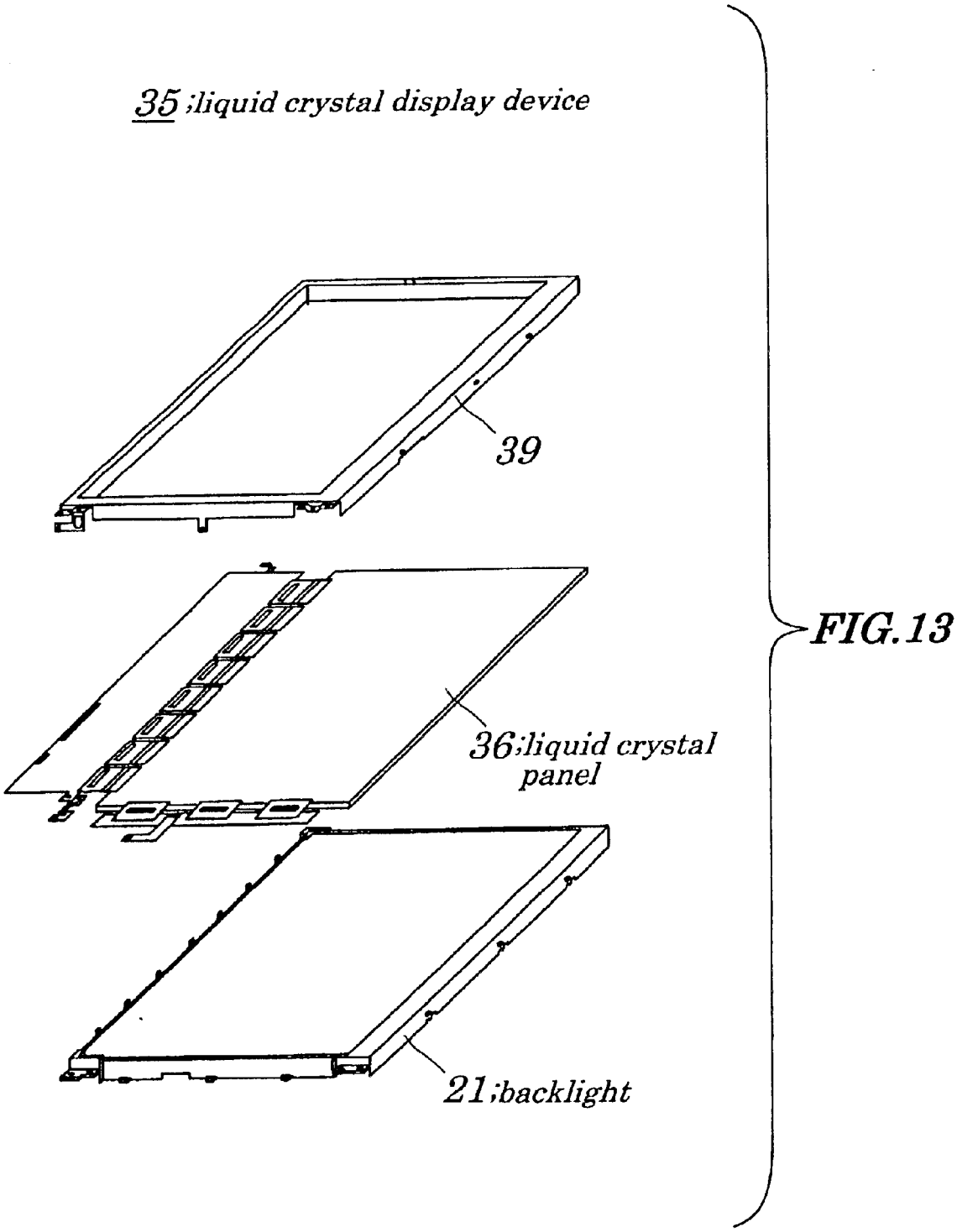
FIG. 13 is an exploded perspective view showing a constitution of a liquid crystal display device of the first embodiment.
Figure 14:
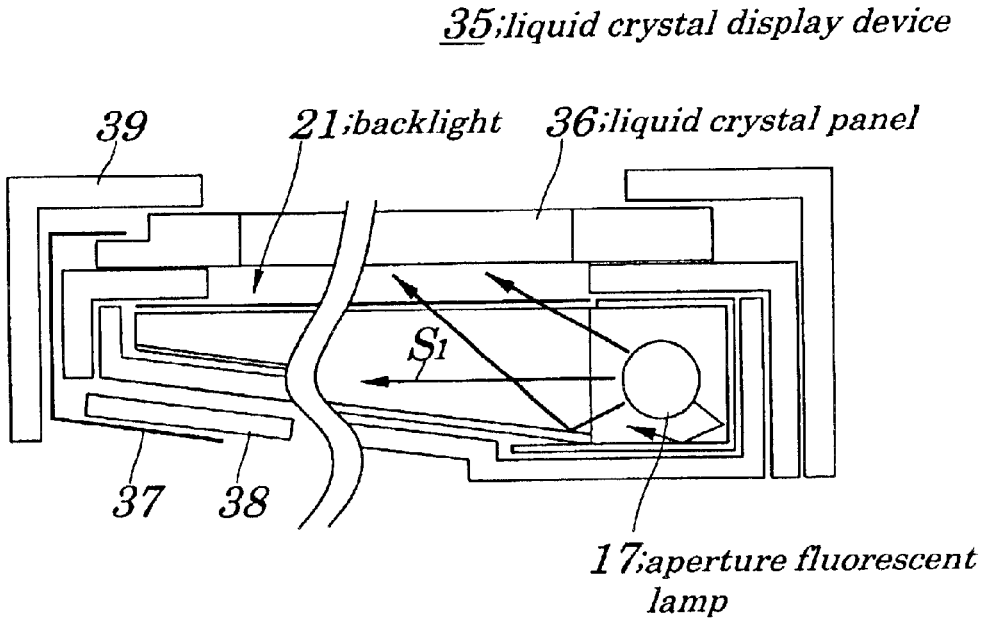
FIG. 14 is a sectional view showing the constitution of the liquid crystal display device of the first embodiment.
Figure 15:
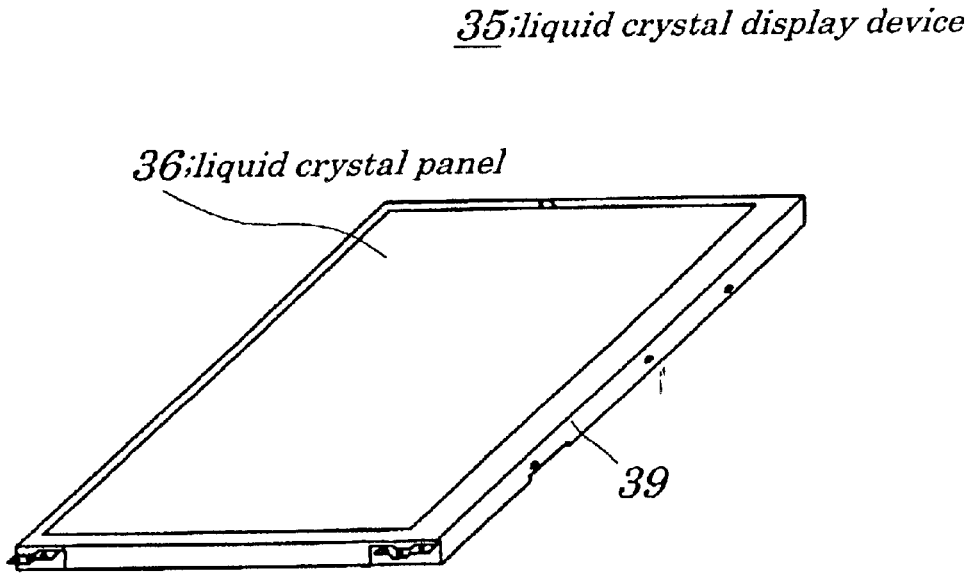
FIG. 15 is a perspective view showing the constitution of the liquid crystal display device of the first embodiment.

FIGS. 1A, 1B, 2A and 2B are process views illustrating an aperture fluorescent lamp manufacturing method according to a first embodiment of the present invention. FIGS. 3A and 3B are views illustrating the aperture fluorescent lamp manufacturing method of the first embodiment. Specifically, FIG. 3A is a sectional view taken along line A—A of FIG. 1A and FIG. 3B is a sectional view taken along line B—B of FIG. 2B. FIG. 4 is a view illustrating the aperture fluorescent lamp manufacturing method of the first embodiment; and FIG. 5 is a sectional view showing a constitution of the aperture fluorescent lamp. FIG. 6 is another sectional view showing the constitution of the aperture fluorescent lamp; and FIG. 7 is a partially expanded perspective view showing a constitution of a lead conductor of the aperture fluorescent lamp. FIG. 8 is a characteristic view showing a relation (directional characteristic) between a radiation direction and luminance of the aperture fluorescent lamp. FIG. 9 is a partially expanded perspective view showing an end portion of a reflector of the first embodiment. FIG. 10 is an exploded perspective view showing a constitution of a backlight of the first embodiment. FIG. 11 is a sectional view showing the constitution of the backlight. FIG. 12 is a perspective view showing the constitution of the backlight. FIG. 13 is an exploded perspective view showing a constitution of a liquid crystal display device of the first embodiment. FIG. 14 a sectional view showing the constitution of the liquid crystal display device; and FIG. 15 is a perspective view showing the constitution of the liquid crystal display device.

Now, the manufacturing method of an aperture fluorescent lamp 17 will be described by referring to FIGS. 1A to 7.

First, as shown in FIGS. 1A and 3A, on the inner surface of a cylindrical glass tube 1 opened at both ends, having an outer diameter of 2.0 mm, an inner diameter of 1.6 mm, and a length of 300 mm for example, an ultraviolet ray reflection layer 2 made of metal oxide powder, such as aluminum oxide and zirconium oxide, and a phosphor layer 3 made of plural kinds of phosphors are formed.

Figure 1B:
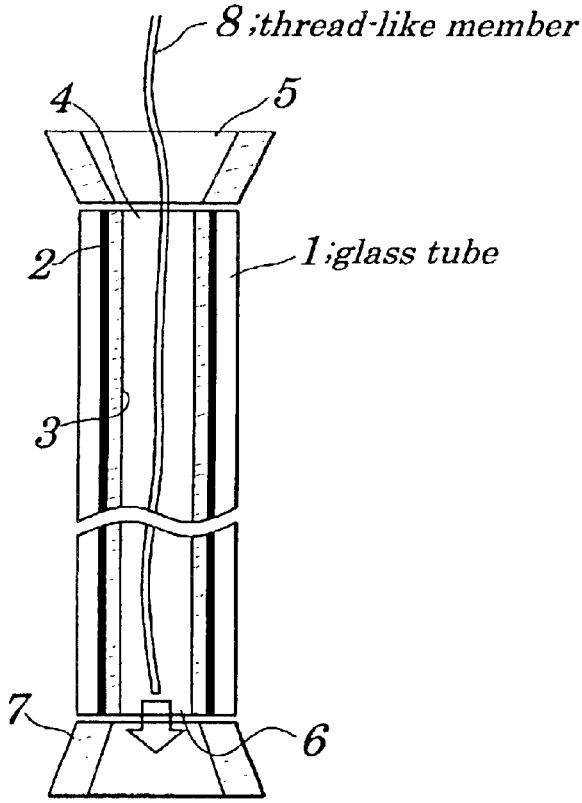

Then, as shown in FIG. 1B, a guiding member 5 trapezoidal in section, which is opened at both ends, is disposed in one opening 4 of the glass tube 1, and a suction nozzle 7 is disposed in the other opening 6. Then, from the opening 4 side, a thread-like member 8 made of, for example, natural fiber is inserted. The thread-like member 8 has a predetermined sufficiently thin diameter (for example, 0.5 mm) to be passed through the glass tube 1, a predetermined surface roughness, and a predetermined tensile strength. A suction device (not shown) is connected to the opening 6 side, the thread-like member 8 is held at a portion away from the end thereof by a length slightly greater than the glass tube 1, suction is started by the suction device, and the thread-like member 8 is inserted into the glass tube 1.

Figure 2A:
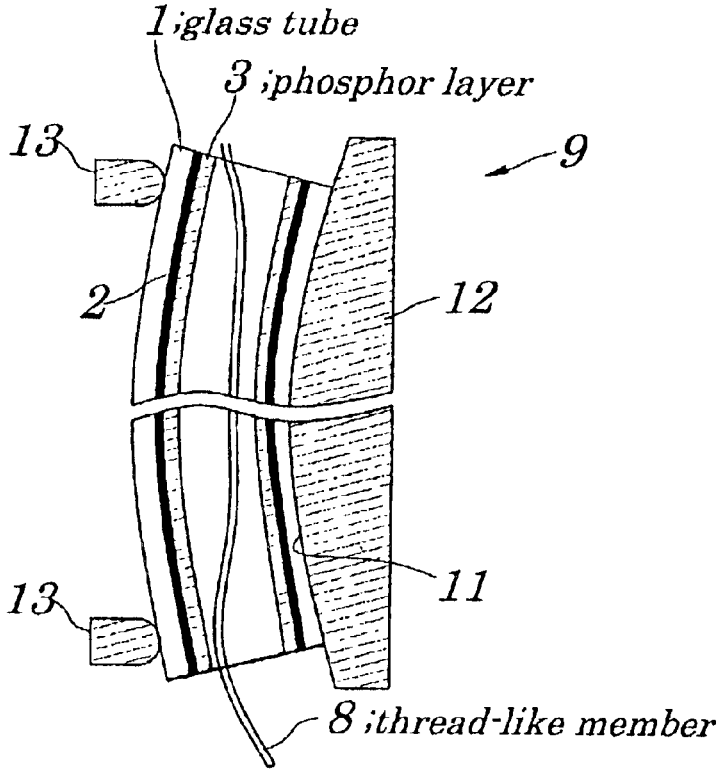
FIGS. 2A and 2B are continued process views illustrating the aperture fluorescent lamp manufacturing method of the first embodiment of the present invention.

Then, as shown in FIG. 2A, the glass tube 1 having the thread-like member 8 inserted therein is pressed by using a bending jig 9 such that the glass tube 1 can be bent in a predetermined shape.

As shown in the same drawing FIG. 2A, the bending jig 9 includes: a bending member 12 which is bent such that a line on a surface thereof in contact with a part of the outer peripheral surface of the glass tube 1 can have a predetermined curvature, has a groove part 11 circular arc-shaped in section and abutted in close contact to a part of the outer peripheral surface of the glass tube 1, and contacts the glass tube 1; and pressing members 13 and 13 for pressing the glass tube 1 from a side opposite to the bending member 12 so as to sandwich the glass tube 1.

The groove part 11 of the bending member 12 is bent in a manner corresponding to the bending strength of the glass tube 1.

Here, while the glass tube 1 is abutted to the bending member 12, the pressing members 13 and 13 are pressed near the both openings 4 and 6 of the glass tube 1, and fixed when the glass tube 1 is bent to roughly coincide with the bending manner of the groove part 11. In this case, a distance h between a chord connecting both ends of an arc in a side in contact with the groove part 11 in a longitudinal section including the axis of the glass tube 1 and the midpoint of the arc is set in the range of, for example, 2 mm to 5 mm (see FIG. 4).

Figure 2B:
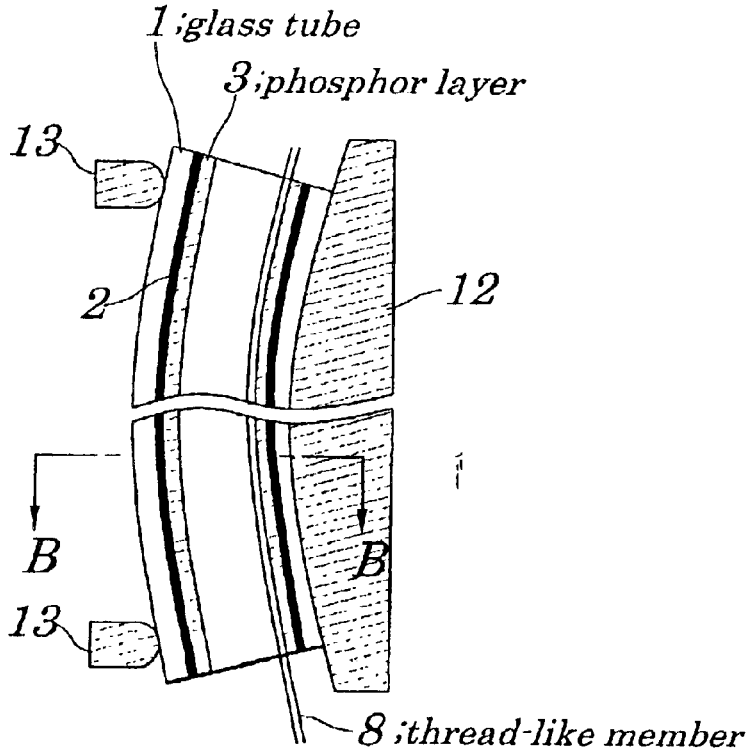

Then, as shown in FIGS. 2B and 3B, while both ends of the thread-like member 8 are pulled with a predetermined tensile force, the thread-like member 8 is pressed to the phosphor layer 3 formed in a predetermined region in the bending member 12 side of the glass tube 1. Then, by reciprocating the thread-like member 8 in the axial direction of the glass tube 1, the phosphor of the phosphor layer 3 of this region is exfoliated.

Then, the pressing members 13 and 13 are loosened, and, after rotating the glass tube 1 around the axis thereof by a predetermined angle (angular displacement), the glass tube 1 is pressed again. Then, the thread-like member 8 is reciprocated to exfoliate the phosphor.

The steps of the rotation of the glass tube 1 and the reciprocation of the thread-like member 8 are repeated, and a belt-like aperture portion 14 is formed in the axial direction of the glass tube 1 to have a predetermined width, that is, a predetermined opening angle θ1 around the axis of the glass tube 1 (see FIG. 5). In the described embodiment, the opening angle $\theta_1$ is set in a range of about 40° to 143°, for example about 90°.

Then, the thread-like member 8 and the exfoliated phosphor remaining in the glass tube 1 are sucked out of the glass tube 1 by the suction device, the thread-like member 8 is pulled out, and unnecessary phosphor is eliminated.

Subsequently, as shown in FIG. 6, electrodes 16 and 16 made of nickel, tantalum, or the like are attached to the glass tube 1, lead conductors 15 being connected thereto. Then, mercury gas and inert gas are enclosed and sealed in, thereby completing an aperture fluorescent lamp 17.

The aperture fluorescent lamp 17 thus completed includes: a cylindrical gas tube 1 having both ends closed, containing mercury gas and inert gas sealed inside, and having an outer diameter of 2.0 mm, an inner diameter of 1.6 mm, and a length of 300 mm; and a pair of electrodes 16 and 16 sealed to both ends of the glass tube 1. On the inner surface of the glass tube 1 an ultraviolet ray reflection layer 2 and a phosphor layer 3 are formed, and an aperture portion 14 opened by an opening angle $\theta_1$ is formed by eliminating the phosphor layer 3 in a predetermined belt-like region in the axial direction of the glass tube 1.

In this case, a tip part of the lead conductors 15 connected to the electrodes 16 are, as shown in FIG. 7, made to be a forked-shape beforehand, and columnar convex parts 18 and 18 are formed. The convex parts 18 and 18 are formed such that the columnar axis of each convex part 18 can be aligned on a plane including the axis of the glass tube 1 and a normal from the glass tube 1 parallel to a direction $S_1$ (referred to as a main radiation direction) vertical to the axis of the aperture fluorescent lamp 17, having the highest luminance among radiation directions of light emitted from the aperture portion 14.

Next, the operation of the aperture fluorescent lamp 17 will be described.

When an AC voltage of several hundreds to a thousand and several hundreds V is applied between the electrodes 16 and 16 in both ends of the glass tube 1, electric discharging occurs inside the glass tube 1. As shown in FIG. 5, when ultraviolet rays emitted from mercury atoms Hg excited by electric discharging reach the phosphor layer 3, the ultraviolet rays are converted into visible rays by a phosphor, and the visible rays are emitted toward the inside and outside of the aperture fluorescent lamp 17. In this case, at the time of lighting, a tube current I is set in the range of 4 to 7 mA, a tube voltage V is set in the range of 680 to 650 Vrms, and light emission is carried out by high light emission efficiency corresponding to the inner diameter of 1.6 mm of the aperture fluorescent lamp 17.

In addition, the ultraviolet rays moving away from the aperture portion 14 are also reflected on the ultraviolet ray reflection layer 2, and brought into contact with the phosphor of the opposite surface to be converted into visible rays. Since the ultraviolet rays are brought into direct contact with the inside of the phosphor layer 3, comparing luminance between the visible rays directed toward the inner side of the aperture fluorescent lamp 17 and the visible rays directed to the outside, the visible rays directed to the inside have higher luminance.

The visible rays directed to the inside with a high luminance are discharged through the aperture portion 14 to the outside of the aperture fluorescent lamp 17. Thus, at the aperture portion 14, light having luminance higher than those of the other portion is discharged.

The aperture fluorescent lamp 17 has, for example, as shown in FIG. 8, a luminance directional characteristic. In FIG. 8, the main radiation direction $S_1$ is used as a reference, and this direction is set equal to 0°. Luminance is shown while the luminance in the 0° direction is 100%. Here, the angle ranges of 315° to 0° and 0° to 45° correspond to the aperture portion 14.

As apparent from FIG. 8, the luminance of light emitted from the aperture portion 14 is about 2.5 times larger than that of light emitted from a region other than the aperture portion 14.

Next, the manufacturing method of a backlight 21 (surface illuminator) will be described by using the aperture fluorescent lamp 17 manufactured in the foregoing manner.

First, as shown in FIGS. 9 and 10, a reflector 26 groove-shaped in section is prepared, which has upper and lower flange parts 22 and 23, a web part 24, and end parts (supporting members) 25.

In the both end parts 25, as shown in FIG. 9, attachment hole parts 27 and 27 are formed to be fitted around the convex parts 18 and 18 for attaching the aperture fluorescent lamp 17. Center positions of the attachment hole parts 27 and 27 are set at a predetermined height from the lower flange part 23.

The convex part 18 of the lead conductor 15 is fitted in the attachment hole parts 27 of the reflector 26, and the aperture fluorescent lamp 17 is attached to the reflector 26. The opening angle $\theta_1$ of the aperture portion 14 of the aperture fluorescent lamp 17 used herein is set in the range of about 40° to 143° (for example, about 90°) as described above. This angle is set corresponding to the outer diameter (2.0 mm in the described embodiment) of the aperture fluorescent lamp 17, the thickness (3.0 mm in the embodiment) of a later-described light guide plate, a distance (1.5 mm in the embodiment) from the axis of the aperture fluorescent lamp 17 to the end part of the light guide plate, or the like.

Then, the reflector 26 having the aperture fluorescent lamp 17 attached thereto is disposed in an end part on a rear case 28 (holding frame member) for holding the aperture fluorescent lamp 17 and a later-described light guide unit (see FIG. 10). In this state, the aperture portion 14 is positioned and fixed such that the center position of an opening can be set at a predetermined height, and the main radiation direction $S_1$ can be set in a direction (horizontal direction in FIG. 11) parallel to the upper surface of the rear case 28.

On the rear case 28, a reflection sheet 29 for reflecting light emitted from the aperture fluorescent lamp 17 to the light guide plate side, a light guide plate 31 made of acrylic, polycarbonate, or the like, having a thickness set equal to, for example, about 3.0 mm, an optical correction sheet 32 composed of a prism sheet, a diffusion sheet, or the like for improving the luminance in a normal direction and luminance uniformity, are sequentially laminated. Last, by putting a center case 33 (holding frame member) for cover, backlight 21 is completed as shown in FIG. 12.

The backlight 21 thus completed includes: the aperture fluorescent lamp 17 for emitting light from the aperture portion 14 in a concentrated manner; the reflector 26 and the light guide unit composed of the reflection sheet 29, the light guide plate 31, and the optical correction sheet 32 sequentially laminated for reflecting and diffusing the light emitted from the aperture fluorescent lamp 17 to form an area light sources and the rear and center cases 28 and 33 as a casing.

In this case, as shown in FIG. 11, the aperture fluorescent lamp 17 is accommodated in a roughly square-column-shaped housing space 34 surrounded with the reflector 26 in three directions (that is, upper and lower side parts, and outer side part) excluding the light guide plate 31 side, and attached to the reflector 26 after a clearance is secured with the inner wall surface of the reflector 26 for reflecting light emitted from other than the aperture portion 14 on the reflector 26 and making the light incident on the light guide plate 31. For example, the longitudinal width $a_1$ (distance between the inner wall surfaces of the both upper flange part 22 and lower flange part 23 of the reflector 26) of the cross section of the housing space 34 is set in the range of 3.0 mm to 4.0 mm.

In addition, clearances $b_1$ and $c_1$ of the upper and lower flange parts 22, 23 are set in the range of 0.5 mm to 1.0 mm. The transverse width $d_1$ (width of the upper flange part 22 in the upper side of the reflector 26) of the housing space 34 is set in the range of 3.0 mm to 4.0 mm.

Next, the operation of the backlight 21 will be described.

In the backlight 21, among light emitted from the aperture portion 14, light emitted in a direction (horizontal direction indicated by an arrow $S_1$ in FIG. 11) parallel to the light emission surface travels straight and is reflected on the reflection sheet 29, and then is passed through the light guide plate 31 and is emitted from the optical correction sheet 32. Light emitted upward (direction indicated by an arrow $S_2$ in FIG. 11) is directly passed through the light guide plate 31 and emitted from the optical correction sheet 32. Light emitted downward (direction indicated by an arrow $S_3$ in FIG. 11) is immediately reflected on the reflection sheet 29, and then passed through the light guide plate 31 and emitted from the optical correction sheet 32. In addition, visible rays are also emitted from a region other than the aperture portion 14, reflected on an inner wall surface of the reflector 26, guided to the light guide plate 31, and then emitted from the optical correction sheet 32.

Thus, from the emission surface (light emission surface) of the optical correction sheet 32, an illumination light is irradiated toward a surface to be illuminated with uniform luminance.

A liquid crystal display device 35 manufactured by using the backlight 21 includes, as shown in FIGS. 13 to 15: a (transmission-type) liquid crystal panel 36; a tape carrier package (TCP 37) and a printed circuit board (PCB 38) having a liquid crystal driving IC and the like, mounted thereon; the backlight 21 attached under the liquid crystal panel 36 for irradiating an illumination light to the liquid crystal panel 36 from the lower side; and a front chassis plate 39 as a casing for holding the main body of the liquid crystal display device 35.

The liquid crystal panel 36 is, for example, a TFT system panel. This liquid crystal panel 36 includes: a TFT substrate having a TFT formed therein; an opposite substrate fixed oppositely to the TFT substrate through a gap of several $\mu$m, having a colored layer (color filter) formed thereon; a liquid crystal layer sealed in the gap; and a pair of deflection plates disposed outside the TFT substrate and the opposite substrate.

Thus, according to the constitution of the described example, the phosphor is exfoliated by using the thread-like member 8 having a predetermined diameter corresponding to the inner diameter of the glass tube 1. Accordingly, even in the case of the small-diameter glass tube 1 having an inner diameter set equal to, for example, 3 mm or lower, the aperture portion 14 can be easily and accurately formed at low cost.

Even in the case of the glass tube 1 having a long tube length, the aperture portion 14 can be easily and accurately formed at low cost and with high reliability.

By using the small-diameter aperture fluorescent lamp 17 having an inner diameter of about 1.6 mm, light emission efficiency can be improved.

By using the small-diameter aperture fluorescent lamp 17, the thickness and the length in the longitudinal direction (horizontal direction in FIG. 11) of the backlight 21 can be reduced by amounts corresponding to the reduced amount of the diameter of the aperture fluorescent lamp 17. Thus, the thin and lightweight backlight 21 can be obtained. Moreover, by using this backlight 21, the thin, narrow frame, and lightweight liquid crystal display device 35 can be obtained.

In addition, a width $e_1$ (FIG. 11) of a portion of the frame part of the backlight 21, for example, above the aperture fluorescent lamp 17, can be narrowed by an amount corresponding to the reduced amount of the diameter of the aperture fluorescent lamp 17, and a ratio of a light surface area to the entire area of the backlight 21 can be increased. Also, a ratio of the display surface area of the liquid crystal display device 35 to the entire area can be increased in a corresponding manner.

The positioning of the aperture portion 14 can be easily and surely performed only by fitting the convex parts 18 and 18 in the attachment hole parts 27 and 27. Thus, work efficiency can be increased, yield can be improved, and even work automation can be dealt with.

Second Embodiment

Figure 16A:
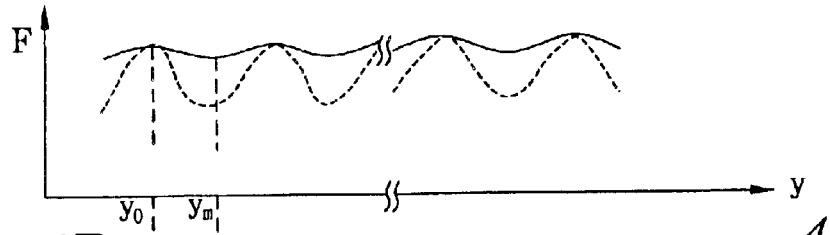
FIGS. 16A and 16B are views illustrating an operation or a constitution of a backlight according to a second embodiment of the present invention, specifically FIG. 16A being a characteristic view showing a relation (luminance distribution characteristic) between a position on a light emission surface of the backlight in a vertical axis direction and luminance above the backlight, and FIG. 16B being a sectional view showing the constitution of the backlight.
Figure 16B:
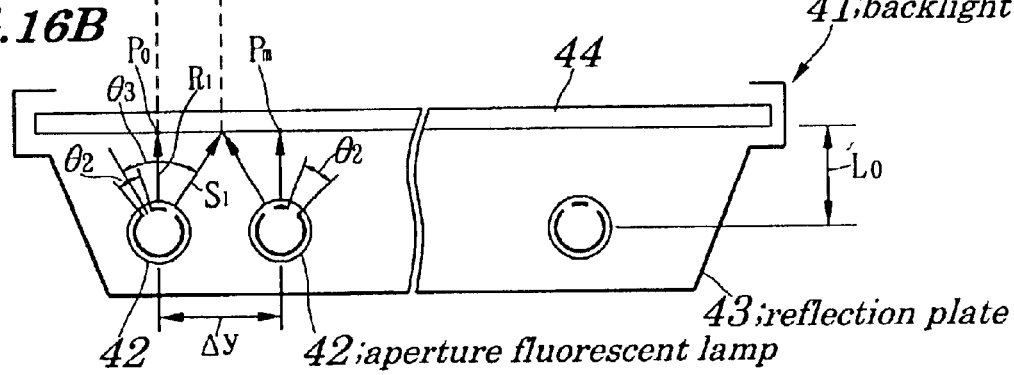
Figure 17:
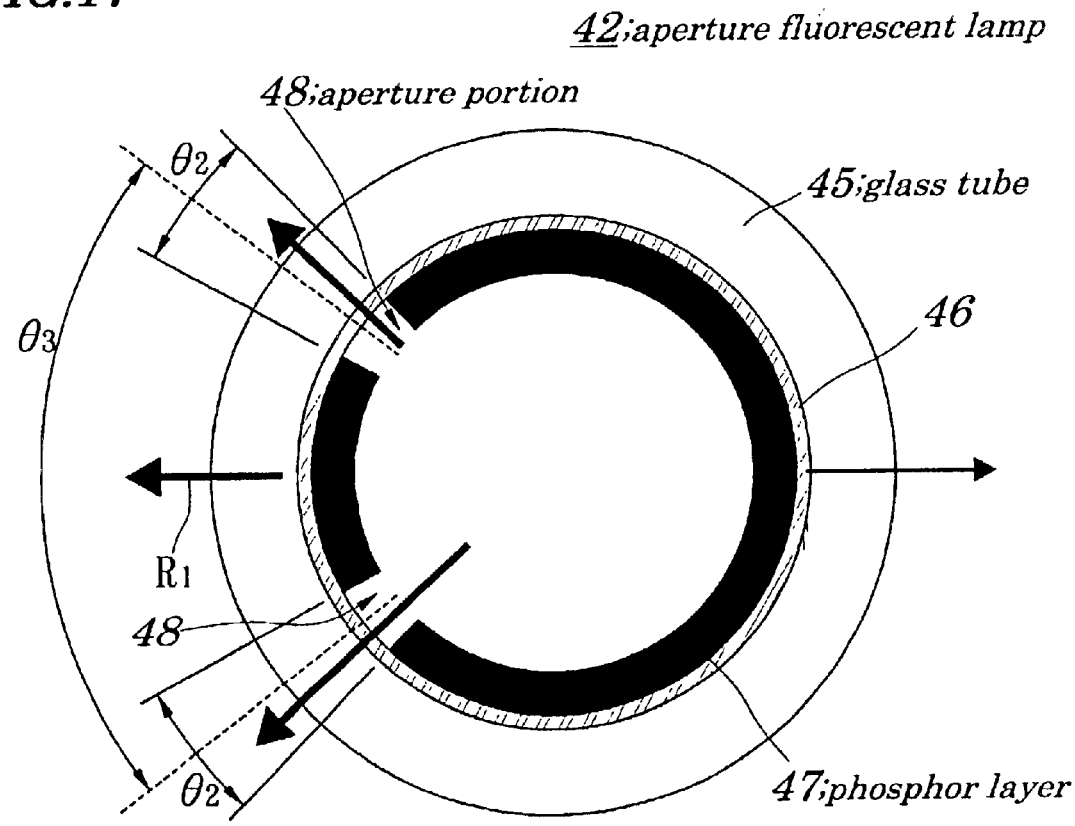
FIG. 17 is a sectional view illustrating a constitution of an aperture fluorescent lamp of the second embodiment.

FIGS. 16A and 16B are views illustrating operation or constitution of a backlight according to a second embodiment of the invention. Specifically, FIG. 16A is a characteristic view showing a relation (luminance distribution characteristic) between a position of a light emission surface of the backlight in a vertical axis direction and luminance above the backlight, and FIG. 16B is a sectional view showing the constitution of the backlight. FIG. 17 is a sectional view illustrating a constitution of an aperture fluorescent lamp of the embodiment; and FIG. 18 a characteristic view showing a relation (directional characteristic) between a radiation direction and luminance of the aperture fluorescent lamp.

The backlight of the second embodiment is different from the backlight of the first embodiment in the following respects. That is, while the aperture fluorescent lamp having an aperture portion provided in one place is used in the first embodiment, in the second embodiment, the backlight is constructed by using the aperture fluorescent lamp having aperture portions provided in two places so as to obtain a predetermined luminance directional characteristic. While the backlight of a side-light type is employed in the first embodiment, in the second embodiment, the backlight of a directly-below type is employed.

Other components are roughly similar to those of the first embodiment, and thus only brief description thereof will be made.

As shown in FIG. 16B, the backlight 41 (surface illuminator) of the embodiment includes: a plurality of aperture fluorescent lamps 42, 42 . . . , arrayed with predetermined intervals Δy; a reflection plate 43 for reflecting light emitted from each aperture fluorescent lamp 42 and also serving as a casing; and a diffusion plate 44 disposed in a position keeping a predetermined distance $L_0$ from each aperture fluorescent lamp 42, and adapted to obtain a surface light source by diffusing the emitted light or reflected light from the reflection plate 43. The backlight 41 exhibits a luminance distribution characteristic of a shallow wave like that indicated by a solid line in FIG. 16A. For comparison, in FIG. 16A, a luminance distribution characteristic when an aperture fluorescent lamp 17 of the first embodiment is used is indicated by a broken line. In the embodiment, the interval Δy is set equal to about 33 mm, and the predetermined distance $L_0$ is set equal to about 14 mm.

As shown in FIG. 17, the aperture fluorescent lamp 42 includes: a glass tube 45 and a pair of electrodes (not shown). An ultraviolet ray reflection layer 46 and a phosphor layer 47 are formed on the inner surface of the glass tube 45. Aperture portions 48 and 48 provided with a predetermined angle gap $\theta_3$ are formed by eliminating the phosphor layer 47 in two predetermined belt-like regions in the axial direction of the glass tube 45 and opened around the axis of the glass tube 45 respectively with predetermined opening angles $\theta_2$.

For the aperture fluorescent lamp 42, one having a corresponding dimension, predetermined opening angle $\theta_2$ and predetermined angle gap $\theta_3$ is selected in order to satisfy predetermined specifications (for example, surface luminance, surface luminance uniformity (uniformity ratio of surface luminance), shape dimension, and the like) of the backlight 41. A plurality of aperture fluorescent lamps 42 are arrayed at the predetermined intervals Δy.

In the embodiment, the aperture fluorescent lamp 42 having the predetermined opening angle $\theta_2$ set in the range of about 20° to 40°, (for example, 30°), and the predetermined angle gap $\theta_3$ set in the range of about 90° to 100° corresponding to the predetermined interval Δy, the predetermined distance $L_0$, or the like is used. The outer diameter and the length of the aperture fluorescent lamp 17 are respectively about 2.0 mm and 300 mm.

If the distance $L_0$ is reduced to, for example, 7 mm, the aperture fluorescent lamp 42 having the predetermined angle gap $\theta_3$ set equal to about 130° is used.

Figure 18:
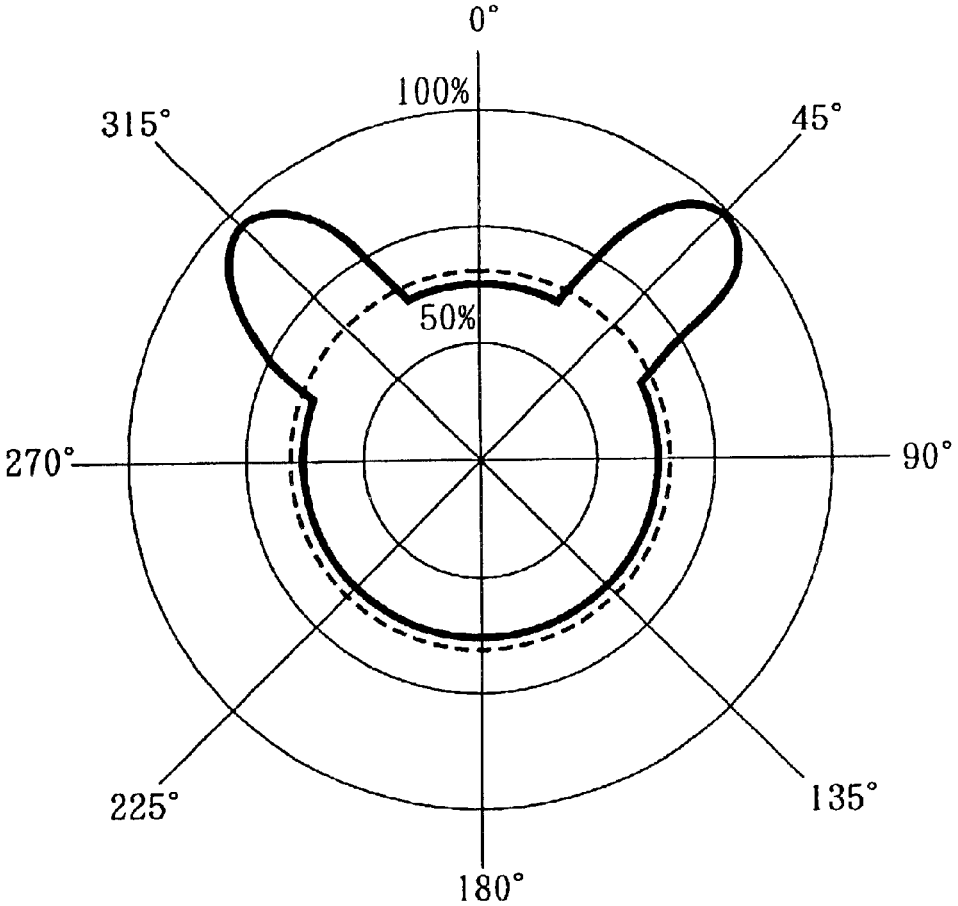
FIG. 18 is a characteristic view showing a relation (directional characteristic) between a radiation direction and luminance of the aperture fluorescent lamp of the second embodiment.

The aperture fluorescent lamp 42 of the embodiment exhibits a luminance directional characteristic like that shown in FIG. 18. In FIG. 17, a direction (referred to as a symmetry axis direction $R_1$) for bisecting an angle made by directions (that is, two main radiation directions $S_1$ and $S_1$) vertical to the axis of the aperture fluorescent lamp 42 having the highest luminance among the radiation directions of light emitted from the aperture portion 48, is used as a reference, and this direction is set equal to 0°. For luminance, the luminance in each of the directions 45° and 315° is set at 100%. Here, the angle ranges from 300° to 330° and from 30° to 60° corresponding to the aperture portions 48 and 48.

Each aperture fluorescent lamp 42 is positioned and fixed such that the symmetry axis direction $R_1$ can be set orthogonal to the upper surface (light emission surface of the backlight 41) of the diffusion plate 44 (that is, to face directly upward in FIG. 16B).

In this case, in the backside of the diffusion plate 44 away directly upward from the axis of the aperture fluorescent lamp 42 by the predetermined distance $L_0$, a luminance difference is set equal to a predetermined value or lower between a position ($y=y_0$) directly above the aperture fluorescent lamp 42 on an y axis in the direction orthogonal to the aperture fluorescent lamp 42, and a position ($y=y_m$) equidistant from the adjacent aperture fluorescent lamps 42 and 42.

Further, by transmitting light through the diffusion plate 44, luminance uniformity is improved. In the upper surface (light emission surface) of the diffusion plate 44, for example, a ratio of a difference ΔF between a luminance $F_0$ at $y=y_0$ and a luminance $F_m$ at $y=y_m$ to the luminance $F_0$ is adjusted to be, for example, about 0.1 or less.

In other words, in the vicinity of a position $P_m$ ($y=y_m$) between the aperture fluorescent lamps 42 and 42, which is farthest from the aperture fluorescent lamp 42 and in which an incident angle (for example, angle between the radiation light direction of the aperture fluorescent lamp 42 and the normal direction of the light emission surface) is large, a pre-adjustment is made such that light emitted from the two aperture fluorescent lamps 42 and 42 can be converged, and a change in luminance between positions $P_0$ and $P_m$ is suppressed.

Thus, since the plurality of aperture fluorescent lamps 42, 42 . . . , each having two main radiation directions of high luminance like those shown in FIG. 18 are arrayed at the predetermined intervals Δy and with the symmetry axis directions $R_1$ aligned, as shown in FIG. 16A, the luminance F above the backlight 41 is gently changed in the y axis direction.

According to the constitution of the embodiment, an advantage roughly similar to that of the first embodiment can be obtained.

In addition, since the plurality of aperture fluorescent lamps 42, 42 . . . , each having two aperture portions 48 and 48, are arrayed with the symmetry axis directions $R_1$ aligned and at the predetermined intervals Δy, the overlapped luminance in the direction vertical to the light emission surface can be roughly adjusted in the vertical axis direction (direction orthogonal to the axis of the aperture fluorescent lamp 42) on the light emission surface, thus improving luminance uniformity.

Further, the small-diameter aperture fluorescent lamp 42 can be used, and the distance $L_0$ between the axis of the aperture fluorescent lamp 42 and the diffusion plate 44 can be set short. Thus, the backlight 41 can be made thin and lightweight.

The preferred embodiments of the present invention have been described with reference to the accompanying drawings. However, a specific constitution is not limited to that of each of the embodiments, and various designing changes and modifications can be made without departing from the teachings of the present invention.

Figure 19:
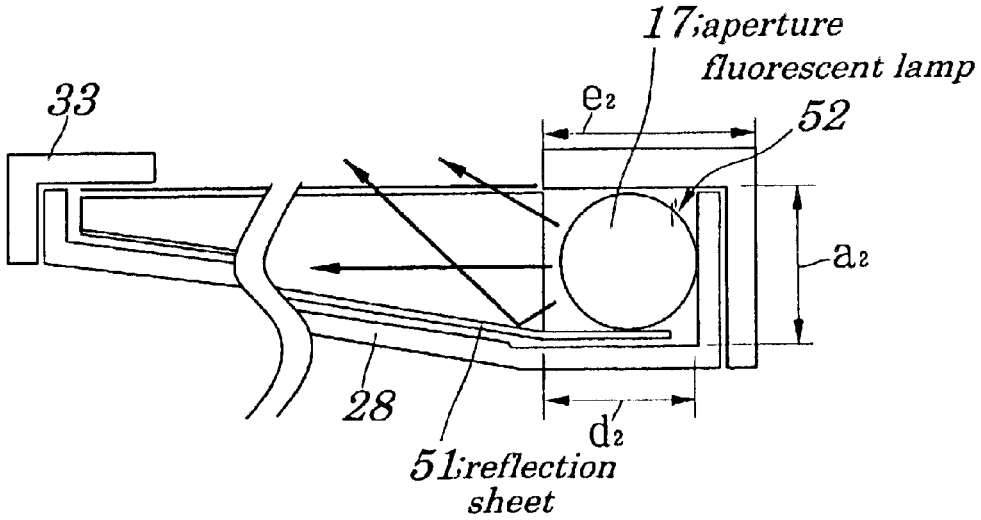
FIG. 19 is a sectional view showing a constitution of a backlight according to a modified example of the first embodiment of the present invention.

For example, as described above, in the first embodiment, between the aperture fluorescent lamp 17 and inner wall surface of a reflector 26, in three directions excluding a light guide plate 31 side, clearances are secured for reflecting light emitted from a region other-than an aperture portion 14 on the reflector 26, and making light incident on the light guide plate 31. However, as shown in FIG. 19, the clearance and the reflector 26 may be omitted, and a reflection sheet 51 may be extended to a part under the aperture fluorescent lamp 17.

In this case, a longitudinal width $a_2$ and the transverse width d of the cross section of the housing space 52 are reduced by amounts corresponding to the omission of the clearances $b_1$ and $c_1$, and the width $e_2$ of a part above the aperture fluorescent lamp 17 of the frame part is also reduced. Thus, thinning, narrow frame formation, and weight reduction can be further facilitated. Moreover, since the number of members can be reduced, material costs, and the number of assembly steps can be reduced, thus bringing about a reduction in manufacturing cost.

Figure 20:
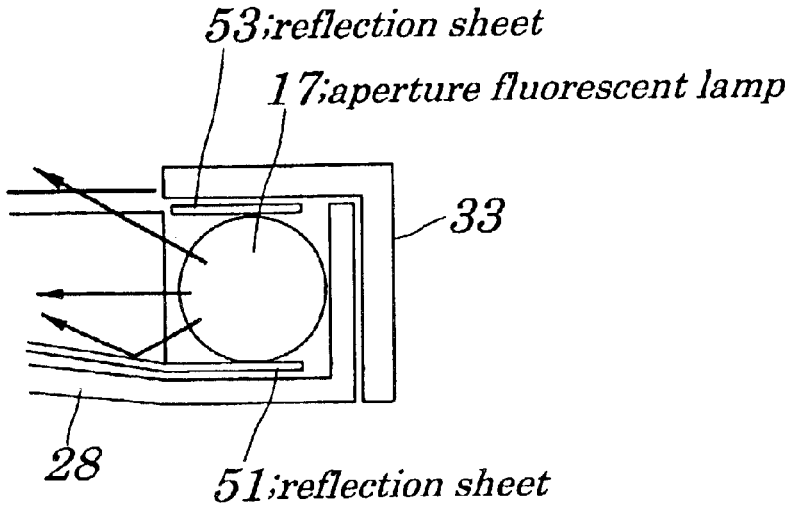
FIG. 20 is a sectional view showing a constitution of a backlight according to another modified example of the first embodiment of the present invention.

Further, as shown in FIG. 20, a reflection sheet 53 may be additionally disposed above the aperture fluorescent lamp 17. Accordingly, the use efficiency of light emitted from other than the aperture portion 14 can be increased.

Figure 21:
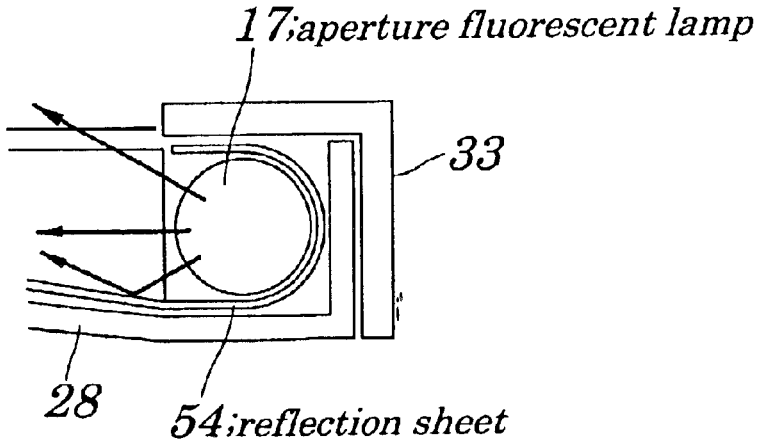
FIG. 21 is a sectional view showing a constitution of a backlight according to yet another modified example of the first embodiment of the present invention.

In addition, as shown in FIG. 21, the above-described clearance and reflector 26 may be omitted, and a reflection sheet 54 may be wound around the aperture fluorescent lamp 17, and extended to a part above the aperture fluorescent lamp 17. In this way, the use efficiency can be increased without increasing the number of members.

Figure 22A:
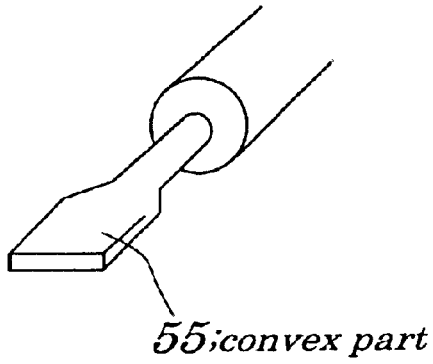
FIGS. 22A and 22B are views illustrating a backlight manufacturing method according to yet another modified example of the first embodiment of the present invention.
Figure 22B:
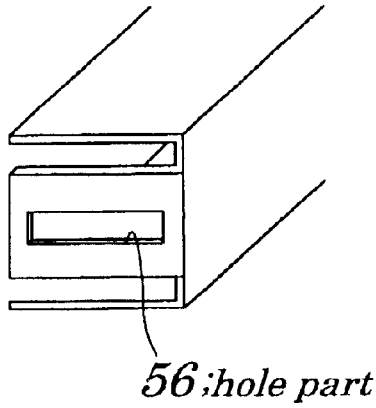
Figure 23A:
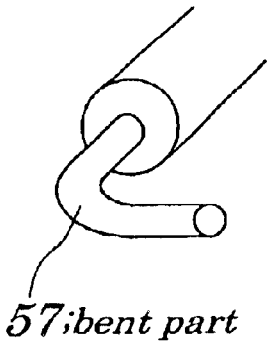
FIGS. 23A and 23B are views illustrating a backlight manufacturing method according to yet another modified example of the first embodiment of the present invention.
Figure 23B:
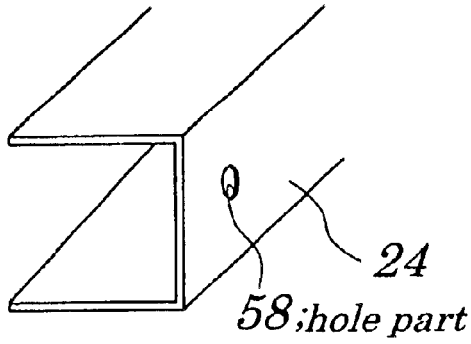

A machining of a tip part of a lead conductor 15 for positioning the aperture fluorescent lamp 17, and corresponding machining of both ends of the reflector 26, are not limited to formation of forked convex parts 18 and two attachment hole parts 27 to fit around the same. For example, a flat plate-like convex part 55 like that shown in FIG. 22A and a rectangular hole part 56 like that shown in FIG. 22B to fit around the convex part 55 may be combined. Alternatively, a bent part 57 having a lead conductor column-shaped in section like that shown in FIG. 23A, and a hole part 58 provided in a web part 24 like that shown in FIG. 23B to fit around the same, may be combined. In this case, as shown, two end parts 25 and 25 are omitted.

In addition, in the foregoing embodiment, a glass tube 1 is fixed, and a thread-like member 8 is reciprocated. However, the glass tube 1 may be reciprocated.

Figure 24:
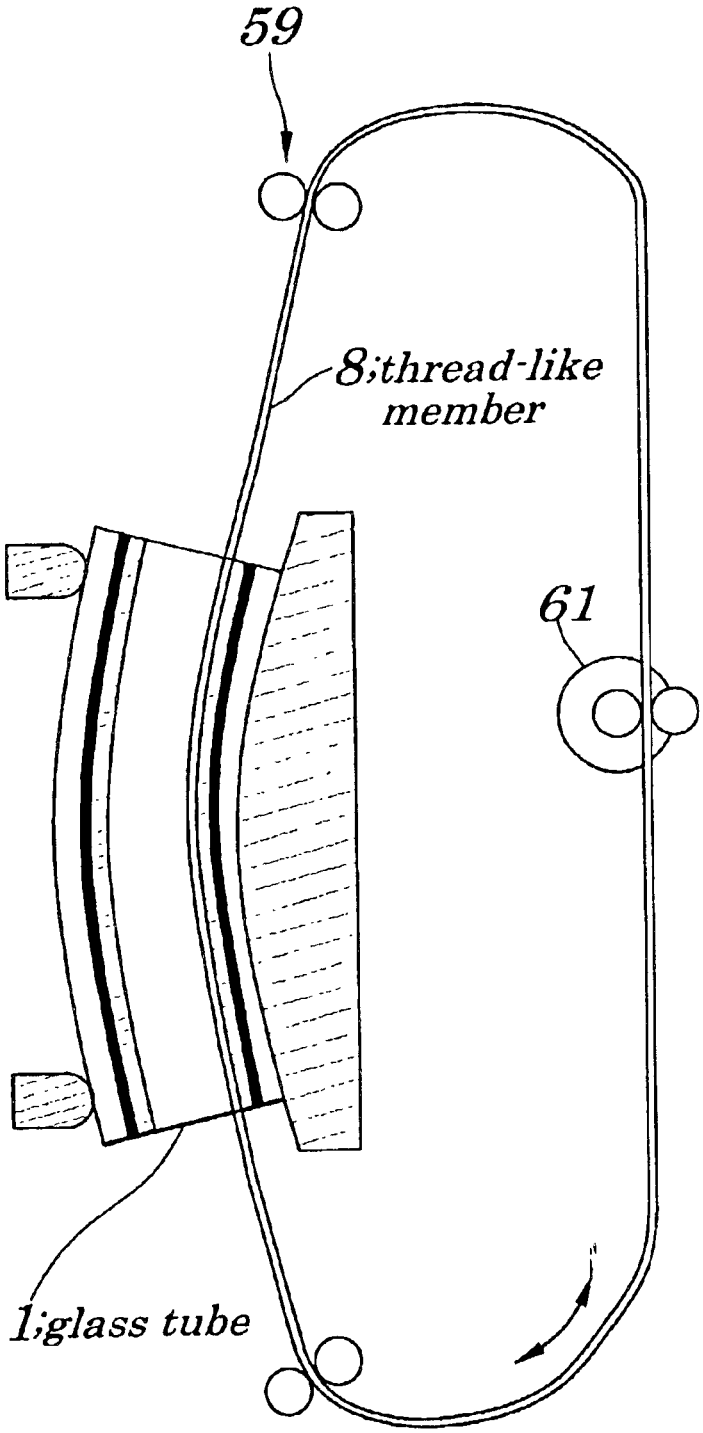
FIG. 24 is a view illustrating an aperture fluorescent lamp manufacturing method according to yet another modified example of the first embodiment of the present invention.

The thread-like member 8 having a predetermined length may be inserted into the glass tube 1, then both ends may be tied or welded. Then, by using a ring-shaped thread-like member 8, as shown in FIG. 24, the thread-like member 8 may be guided to a driving unit 61 using a motor (not shown) through a tension adjustment unit 59 and, by periodically reversing a rotational direction of the motor, the threadlike member 8 may be reciprocated.

By using a relatively long thread-like member 8, the thread-like member 8 may be slid in one direction, instead of the reciprocation.

Figure 25:
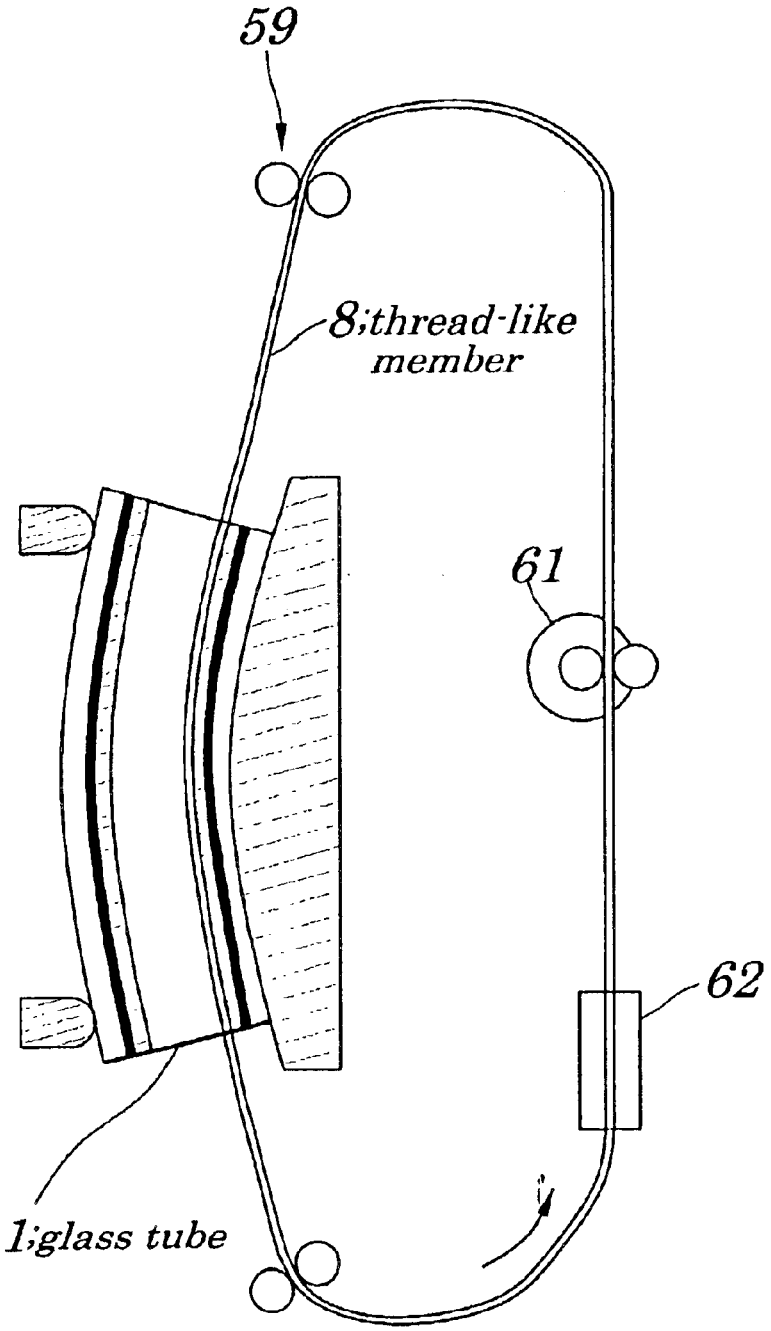
FIG. 25 is a view illustrating an aperture fluorescent lamp manufacturing method according to yet another modified example of the first embodiment of the present invention.

By using the closed thread-like member 8, as shown in FIG. 25, the thread-like member 8 may be guided to the driving unit 61 using the motor (not shown) through the tension adjustment unit 59. The thread-like member 8 may be slid by driving the motor in a fixed direction. In addition, a cleaning unit 62 may be provided, and phosphor stuck to the thread-like member 8 may be eliminated.

The phosphor elimination may be carried out by simultaneously reciprocating the thread-like member 8 in the axial direction of the glass tube 1 and rotating the glass tube 1 around the axis of the glass tube 1.

Moreover, for example, displacement in not only a direction parallel to the axis of the glass tube 1, but also in a direction along a circular arc vertical to the axis may be added. Without bending the glass tube 1, the phosphor may be eliminated while the glass tube 1 is fixed horizontally or vertically.

An attachment hole part to fit around the convex part 18 of the lead conductor 15 may be provided, not in the reflector 26, but in a terminal electrically connected to the lead conductor 15.

Instead of the thread-like member 8 made of natural fiber, for example, a thread-like member made of synthetic fiber for generating static electricity by friction and adsorbing a phosphor may be used. The thread-like member 8 made of carbon fiber or glass fiber may be used.

Figure 26A:
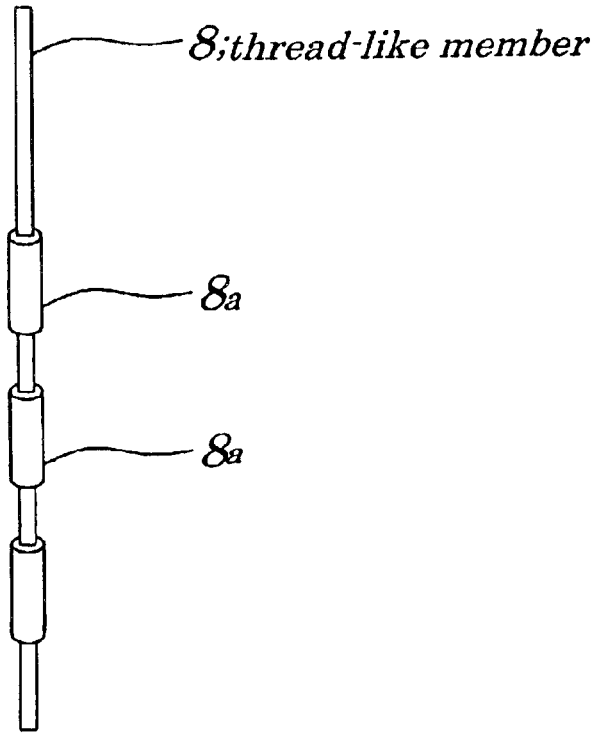
FIGS. 26A and 26B are views illustrating an aperture fluorescent lamp manufacturing method according to yet another modified example of the first embodiment of the present invention.
Figure 26B:
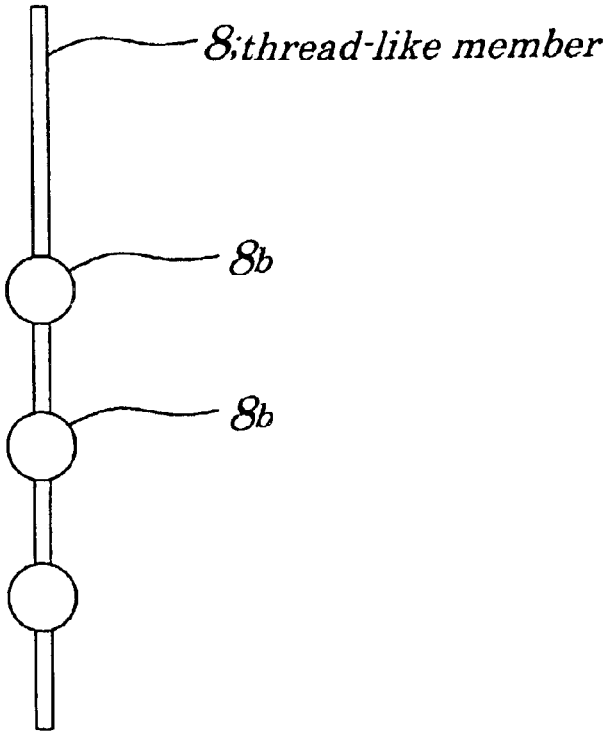

Alternatively, the thread-like member made of metal may be used. Concave/convex machining may be carried out by providing one or more knots in the thread-like member 8. Columnar phosphor exfoliating members 8*a*, 8*a* . . . , made of materials similar to or different in kind from that of the thread-like member 8, like those shown in FIG. 26A, alternatively one or more ball-shaped phosphor exfoliating members 8*b*, 8*b* . . . , like those shown in FIG. 26B, may be attached. Other than the thread-like member 8, a tape member may be used.

Figure 27:
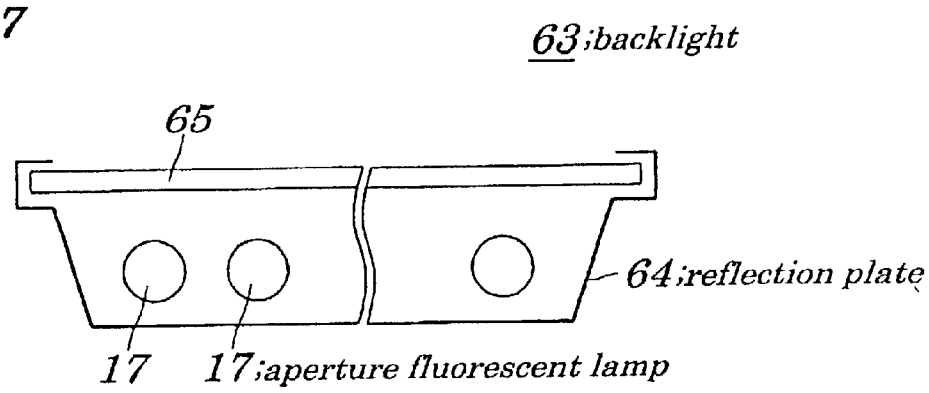
FIG. 27 is a sectional view showing a constitution of a backlight according to a modified example of the second embodiment of the present invention.

As shown in FIG. 27, in the directly-below type backlight 63, the aperture fluorescent lamp 17 may be used.

This backlight 63 includes, as shown in FIG. 27: aperture fluorescent lamps 17, 17 . . . ; a reflection plate 64 for having each aperture fluorescent lamp 17 placed on the bottom surface and reflecting light emitted from each aperture fluorescent lamp 17, and serving also as a casing for accommodating each aperture fluorescent lamp 17; and a diffusion plate 65 for obtaining a surface light source by diffusing emitted or reflected light.

The aperture fluorescent lamps 17 are positioned and arrayed on the bottom surface of the reflection plate 64 while the aperture portions 14 (not shown) face upward.

Accordingly, by using the small-diameter aperture fluorescent lamp 17, even in the case of the directly-below-type backlight, a thin, and lightweight backlight can be obtained. In addition, by using the small-diameter aperture fluorescent lamp 17, light emission efficiency can be increased.

Figure 28:
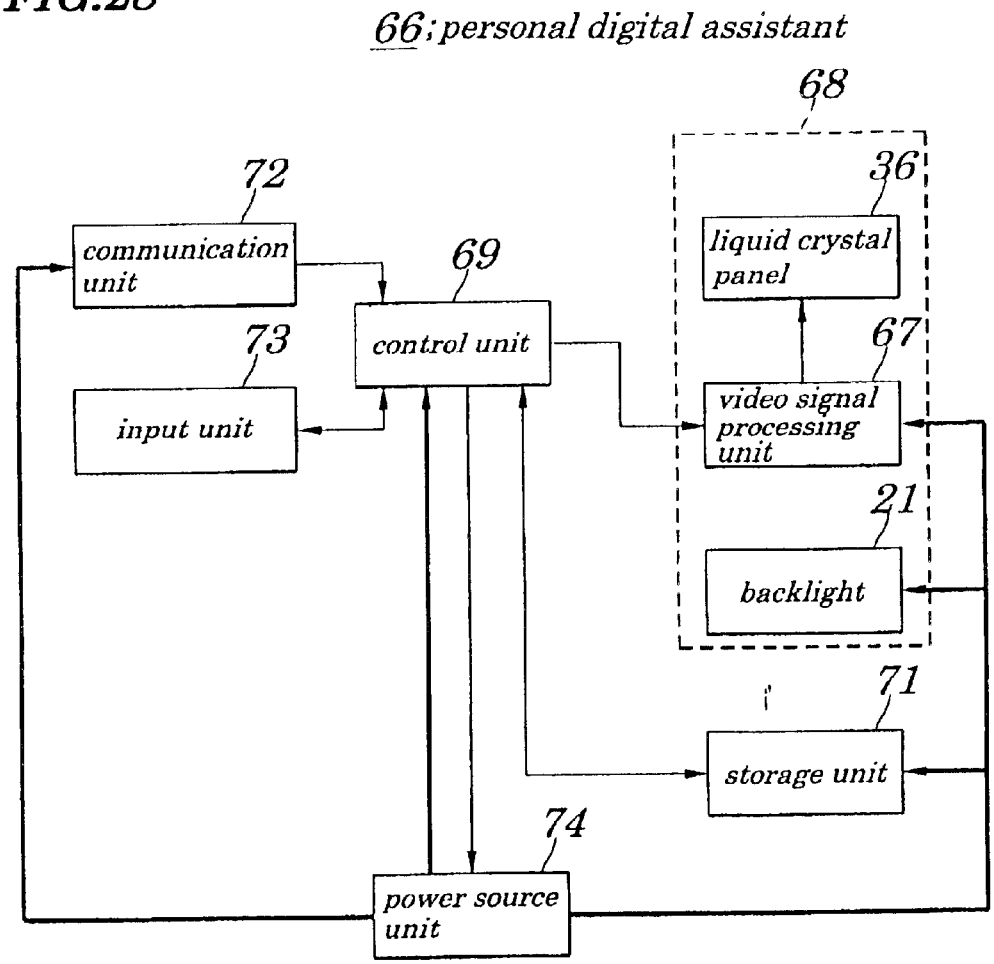
FIG. 28 is a block diagram showing an electrical constitution of a portable information terminal as an electronic device having the aperture fluorescent lamp obtained by using the aperture fluorescent lamp manufacturing method of the first embodiment of the present invention.

In addition, as shown in FIG. 28, by using the backlight 21 of the first embodiment, a personal digital assistant 66 (PDA) as an electronic device can be obtained. This personal digital assistant 66 includes, for example: the foregoing liquid crystal panel 36; a display unit 68 composed of the backlight 21 and a video signal processing unit 67; a control unit 69 for controlling each component; a storage unit 71 for storing processing programs executed by the control unit 69, various data, or the like; a communication unit 72 for performing data communications; an input unit 73 including a keyboard, a pointing device, or the like (not shown); and a power source unit 74 for supplying power to each unit.

As described above, by using the small-diameter aperture fluorescent lamp 17, the display unit 68 can be made thin, narrow-framed, and lightweight more than conventionally. Thus, the personal digital assistant 66 as an electronic device can also be made thin and lightweight.

As an electronic device including the liquid crystal panel 36 and the backlight 21, other than the personal digital assistant 66, the backlight 21 may be applied to a portable personal computer, a notebook personal computer, or the like.

Figure 29:
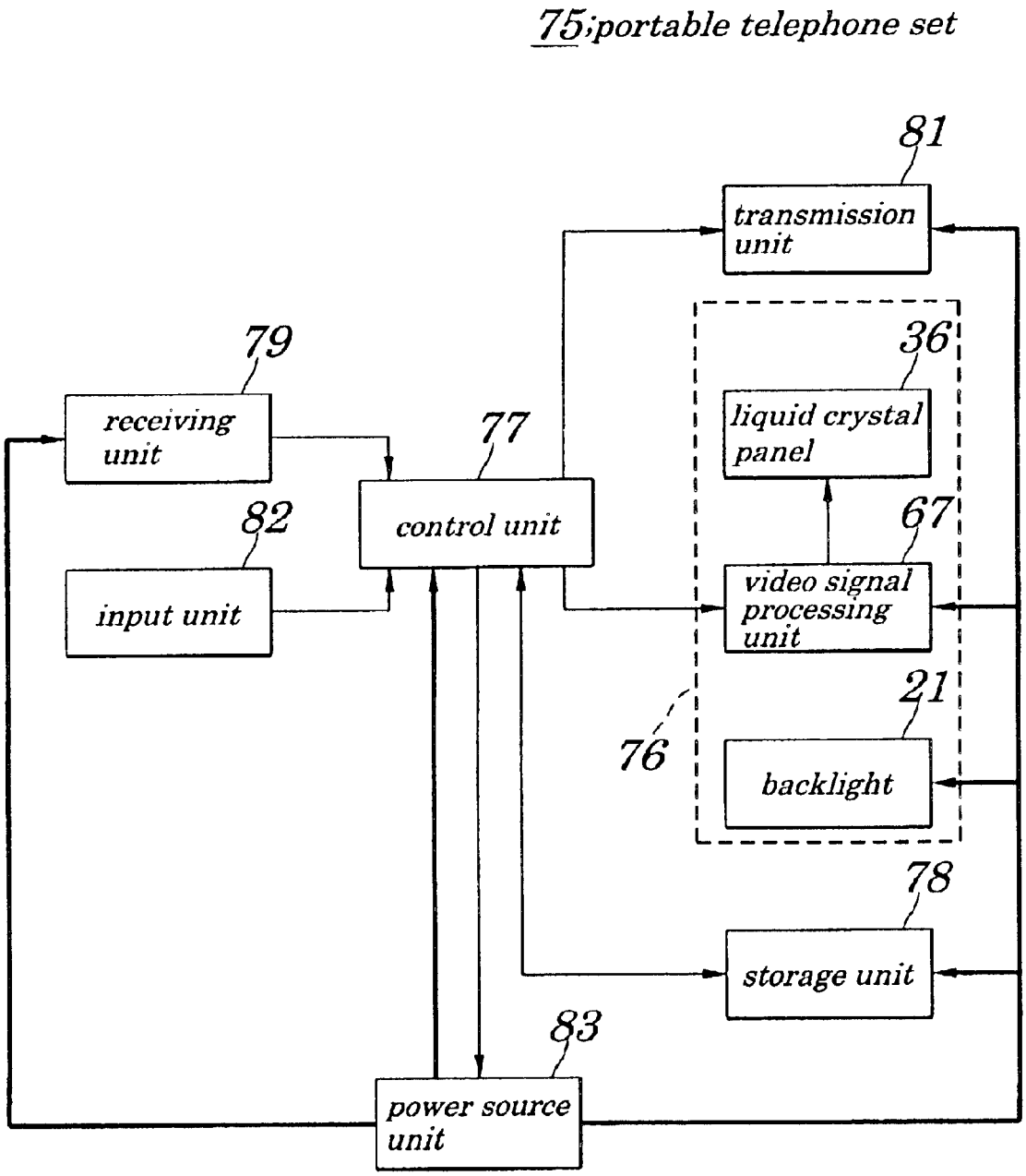
FIG. 29 is a block diagram showing an electrical constitution of a portable telephone set as an electronic device having the aperture fluorescent lamp obtained by using the aperture fluorescent lamp manufacturing method of the first embodiment of the present invention.
Figure 30:
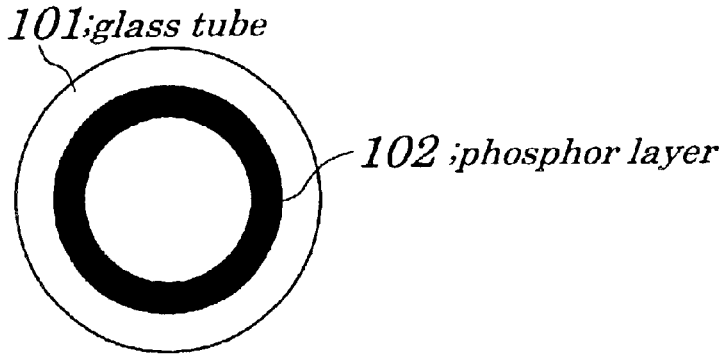
FIG.30 (PRIOR ART)
FIG. 30 is a view illustrating a first conventional technology.
Figure 31:
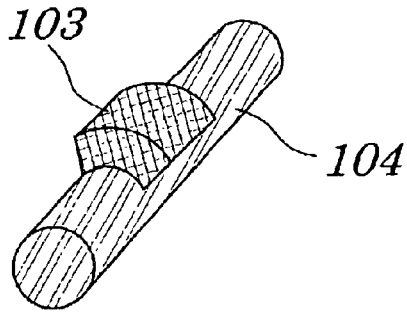
FIG.31 (PRIOR ART)
FIG. 31 is a view illustrating the first conventional technology.
Figure 32:
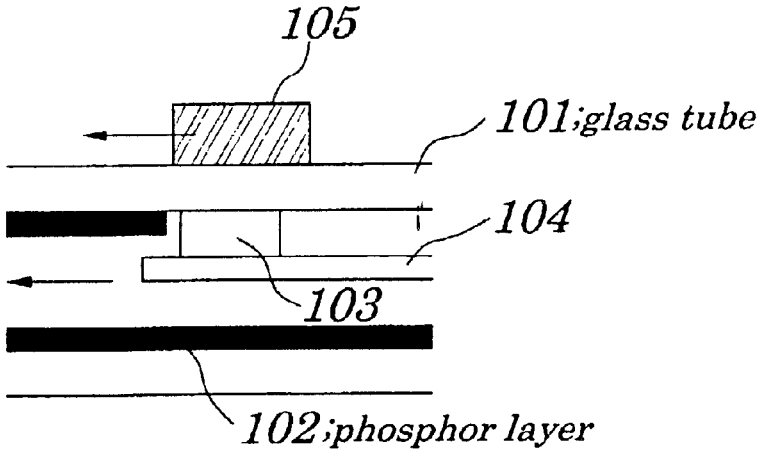
FIG.32 (PRIOR ART)
FIG. 32 is a view illustrating the first conventional technology.
Figure 33:
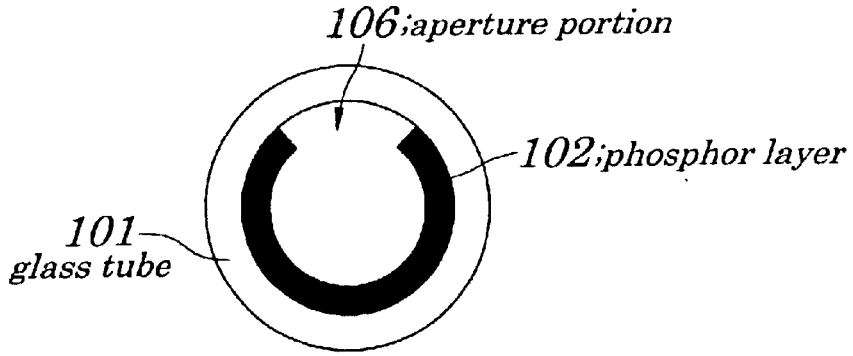
FIG.33 (PRIOR ART)
FIG. 33 is a view illustrating the first conventional technology.
Figure 34:
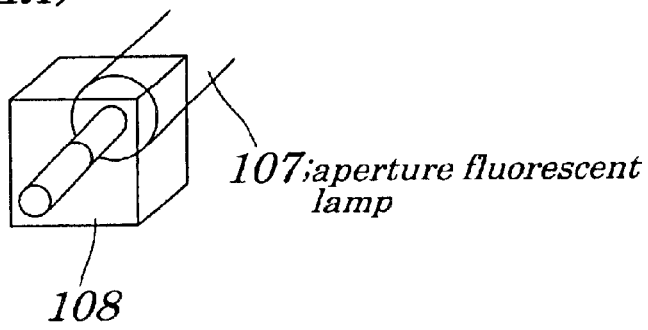
FIG.34 (PRIOR ART)
FIG. 34 is a view illustrating a second conventional technology.
Figure 35:
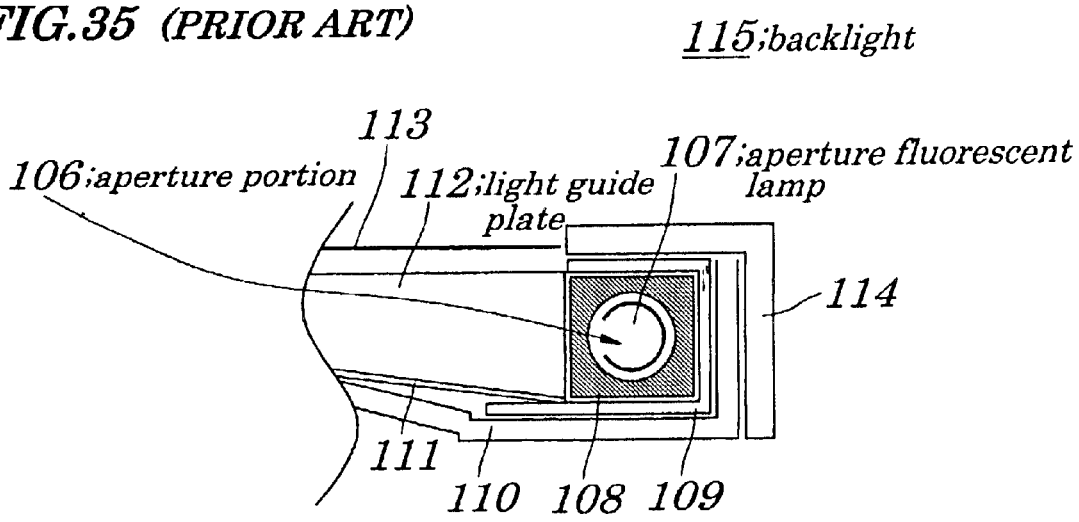
FIG.35 (PRIOR ART)
FIG. 35 is a view illustrating the second conventional technology.
Figure 36:
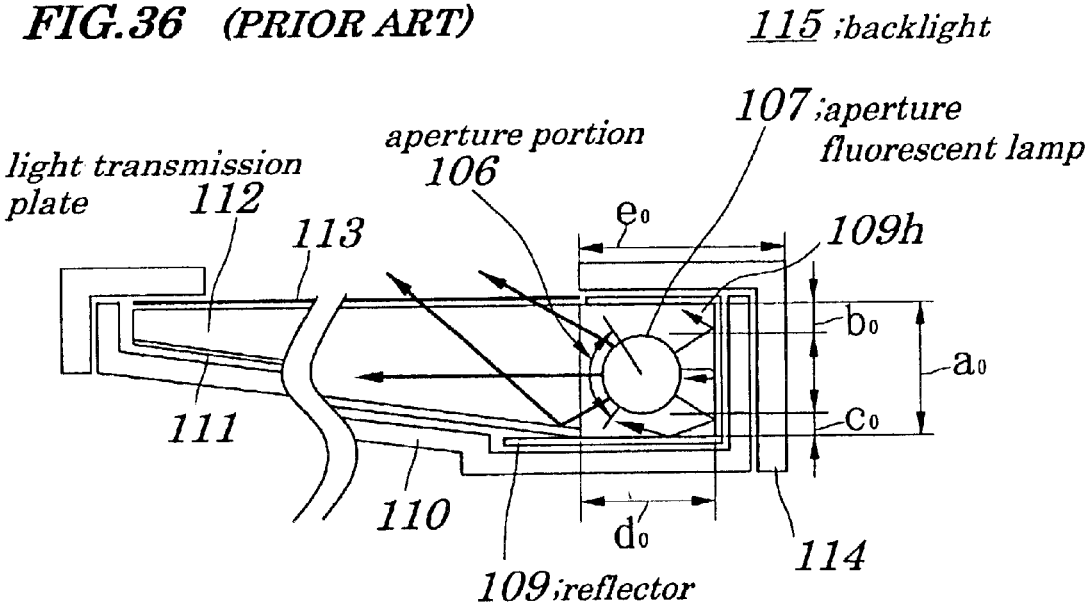
FIG.36 (PRIOR ART)
FIG. 36 is a view illustrating the second conventional technology.
Figure 37A:
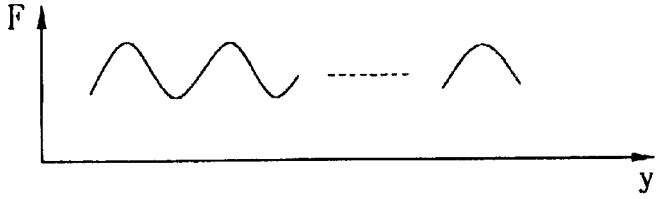
FIG.37A (PRIOR ART)
FIGS. 37A and 37B are views illustrating a conventional directly-below type backlight.
Figure 37B:
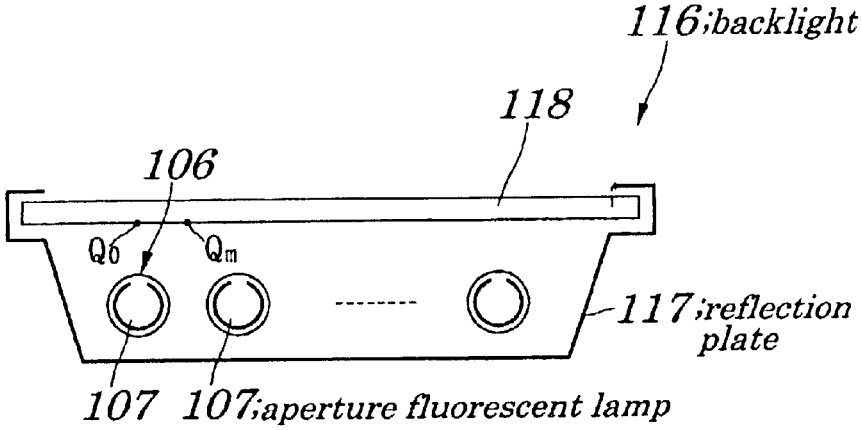
FIG.37B (PRIOR ART)
Figure 38:
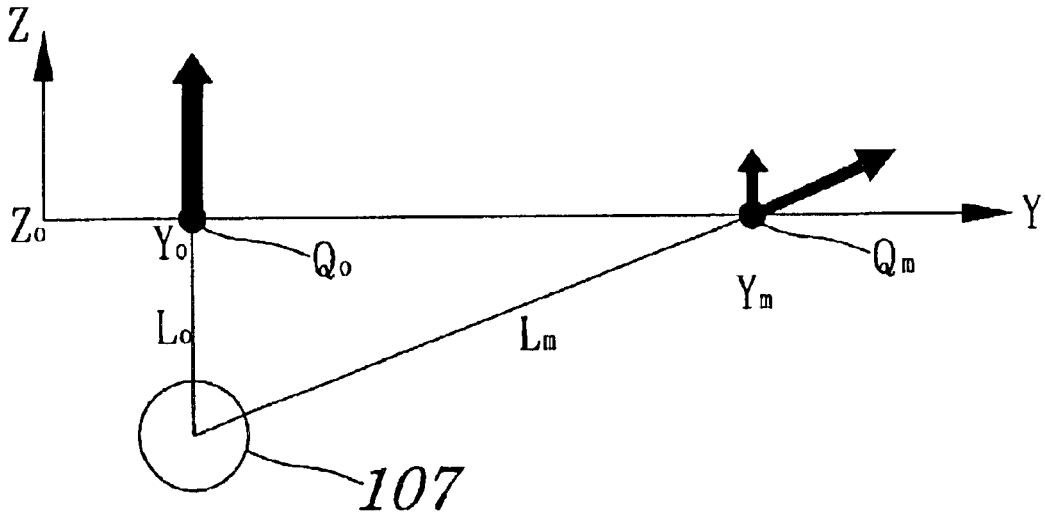
FIG.38 (PRIOR ART)
FIG. 38 is a view illustrating the conventional directly-below type backlight.

Furthermore, as shown in FIG. 29, the backlight 21 may be applied to, for example, a portable telephone set (electronic device) 75. As shown in FIG. 29, this portable telephone set 75 includes: a display unit 76 composed of the liquid crystal panel 36, the backlight 21, a video signal processing unit 67; a control unit 77; a storage unit 78; receiving and transmission units 79 and 81 for receiving and transmitting a radio signal; an input unit 82; and a power source unit 83. Thus, the portable telephone set can be made thin, narrow-framed, and lightweight more than conventionally.

It is apparent that the present invention is not limited to the above embodiments but may be changed and modified without departing from the scope and spirit of the invention.

What is claimed is:

1. An aperture fluorescent lamp, comprising:

a phosphor layer formed on an inner surface of a glass tube; and at least two substantially equal sized aperture portions each formed by eliminating said phosphor layer in a predetermined region in an axial direction of said glass tub and opened for light projection, wherein said at least two substantially equal sized aperture portions are arranged to form a predetermined angle gap which is in a range of about 90° to 100°.

2. The aperture fluorescent lamp according to claim 1, wherein each of said at least two substantially equal sized aperture portions comprises predetermined opening angle with a range of about 20° to 40°.

3. The aperture fluorescent lamp according to claim 1, wherein said glass tube has an inner diameter of about 3 millimeters or less.

4. The aperture fluorescent lamp according to claim 1, wherein said glass tube has an inner diameter of about 1.6 millimeters.

5. The aperture fluorescent lamp according to claim 1, wherein said glass tube comprises a predetermined luminance directional characteristic.

6. A surface illuminator, comprising:

at least one aperture fluorescent lamp including a phosphor layer formed on an inner surface of a glass tube, and two aperture portions formed by eliminating said phosphor layer in a predetermined region in an axial direction of said glass tube and opened for light projection, said at least one aperture fluorescent lamp being disposed on a surface roughly parallel to a light emission surface of said surface illuminator, wherein each of said aperture portions has a belt-like shape, disposed around an axis of said at least one aperture fluorescent lamp to be separated from each other by a predetermined angle gap, and wherein said at least two substantially equal sized aperture portions are arranged to form a predetermined angle gap which is in a range of about 90° to 100°.

7. A surface illuminator, comprising:

a plurality of aperture fluorescent lamps, wherein each aperture fluorescent lamp of said aperture fluorescent amps includes a plurality of aperture portions disposed on a surface roughly parallel to a light emission surface to be directed in a direction roughly perpendicular to said light emission surface, wherein said each aperture fluorescent lamp includes a glass tube having an inner diameter set equal to about 3 millimeters or less, and wherein said at least two substantially equal sized aperture portions are arranged to form a predetermined angle gap which is in a range of about 90° to 100°.

8. The surface illuminator according to claim 7, wherein said glass tube encircles a phosphor layer with said plurality of aperture portions.

9. The surface illuminator according to claim 7, further comprising:

a diffusion plate disposed a predetermined distance from each of said plurality of fluorescent lamps in order to diffuse light emitted from said light emission surface.

10. The surface illuminator according to claim 7, wherein each said aperture fluorescent lamp of said plurality of aperture fluorescent lamps comprises a vertical symmetry axis direction for bisecting an angle formed by two main radiation directions of said plurality of aperture portions.

11. A liquid crystal display device, comprising:

a liquid crystal panel; and a surface illuminator including:

at least one aperture fluorescent lamp including a phosphor layer formed on an inner surface of a glass tube, and two aperture portions formed by eliminating said phosphor layer in a predetermined region in an axial direction of said glass tube and opened for light projection, said at least one aperture fluorescent lamp being disposed on a surface roughly parallel to a light emission surface of said surface illuminator, wherein each of said aperture portions has a belt-like shape, disposed around an axis of said aperture fluorescent lamp to be separated from each other by a predetermined angle gap, and said each of said aperture fluorescent lamps is disposed while a symmetry axis of a cross section of said aperture fluorescent lamp passing through a middle part of two said aperture portions is directed in a direction roughly vertical to said light emission surface, and wherein said at least two substantially equal sized aperture portions are arranged to form a predetermined angle gap which is in a range of about 90° to 100°.

12. An electronic device, comprising:

a liquid crystal display device specified in claim 11.

13. A liquid crystal display device, comprising:

a liquid crystal panel; and a surface illuminator including, a plurality of aperture fluorescent lamps, wherein each aperture fluorescent lamp of said aperture fluorescent lamps includes a plurality of aperture portions disposed on a surface roughly parallel to a light emission surface to be directed in a direction roughly perpendicular to said light emission surface, wherein said each aperture fluorescent lamp includes a glass tube having an inner diameter set equal to about 3 millimeters or less, and wherein said at least two substantially equal sized aperture portions are arranged to form a predetermined angle gap which is in a range of about 90° to 100°.

14. The surface illuminator according to claim 13, wherein said aperture portions comprise angle ranges from 30° to 60° and 300° to 330° to produce a 100% luminance in each one of said angle ranges.

15. The liquid crystal display device according to claim 13, wherein said plurality of aperture fluorescent lamps emit a diffuse light plurality so said liquid crystal panel exhibits a luminous distribution characteristic of a shallow wave.

16. The liquid crystal display device according to claim 13, wherein said glass tube encircles a phosphor layer with said aperture portion.

17. The liquid crystal display device according to claim 13, wherein each aperture fluorescent lamp of said plurality of aperture fluorescent lamps comprises a vertical symmetry axis direction for bisecting an angle formed by two main radiation directions of said plurality of aperture portions.

18. A liquid crystal display device, comprising:

a liquid crystal panel;

a surface illuminator including, a plurality of aperture fluorescent lamps, wherein each aperture fluorescent lamp of said aperture fluorescent lamps includes a plurality of aperture portions disposed on a surface roughly parallel to a light emission surface to be directed in a direction roughly perpendicular to said light emission surface, wherein said each aperture fluorescent lamp includes a glass tube having an inner diameter set equal to about 3 millimeters or less; and a diffusion plate disposed in a predetermined distance from each of said plurality of fluorescent lamps in order to diffuse light emitted from said light emission surface.

19. A backlight, comprising:

a liquid crystal panel; and a surface illuminator including a single aperture fluorescent lamp including an aperture portion disposed on a surface substantially parallel to a light emission surface be directed in a direction substantially perpendicular to said light emission surface, wherein said aperture fluorescent lamp includes a glass tube having an inner diameter set to about 3 millimeters or less, and wherein said backlight comprises a frame above said single aperture fluorescent lamp and said single aperture fluorescent lamp comprises a predetermined diameter, said frame includes reducible portions corresponding to a reduction in said predetermined diameter.

20. The backlight according to claim 19, wherein said reducible portions comprise a longitudinal width in a range of 3.0 mm to 4.0 mm.

21. The backlight according to claim 19, wherein said reducible portions comprise an upper clearance and a lower clearance, each of said upper clearance and said lower clearance comprising a distance within a range of 0.5 mm to 1.0 mm.

* * * * *